US008435055B1

(12) United States Patent
Bhosale

(10) Patent No.: US 8,435,055 B1
(45) Date of Patent: May 7, 2013

(54) TAMPER RESISTANT ELECTRICAL WIRING DEVICE SYSTEM

(75) Inventor: Vikramsinh P. Bhosale, West Babylon, NY (US)

(73) Assignee: Leviton Manufacturing Co., Inc., Melville, NY (US)

( * ) Notice: Subject to any disclaimer, the term of this patent is extended or adjusted under 35 U.S.C. 154(b) by 0 days.

(21) Appl. No.: 13/281,502

(22) Filed: Oct. 26, 2011

(51) Int. Cl.
*H01R 13/44* (2006.01)

(52) U.S. Cl.
USPC ..... 439/145

(58) Field of Classification Search ..... 439/145, 439/137, 188, 140; 174/53, 58, 66
See application file for complete search history.

(56) References Cited

U.S. PATENT DOCUMENTS

| | | | | |
|---|---|---|---|---|
| 2,510,745 | A | 6/1950 | Kilgore | |
| 2,540,496 | A | 2/1951 | Sperazza | |
| 2,826,652 | A | 3/1958 | Piplack | |
| 2,926,327 | A | 2/1960 | Metelli | |
| 3,222,631 | A | 12/1965 | Cohen | |
| 3,238,492 | A | 3/1966 | Houston | |
| 3,617,662 | A | 11/1971 | Miller | |
| 3,775,726 | A | 11/1973 | Gress | |
| 3,986,763 | A | 10/1976 | Sparrow | |
| 3,990,758 | A | 11/1976 | Petterson | |
| 4,072,382 | A | 2/1978 | Reschke | |
| 4,148,536 | A * | 4/1979 | Petropoulsos et al. | 439/188 |
| 4,168,104 | A * | 9/1979 | Buschow | 439/137 |
| 4,271,337 | A | 6/1981 | Barkas | |
| 4,379,607 | A | 4/1983 | Bowden, Jr. | |
| 4,424,407 | A | 1/1984 | Barbic | |
| 4,484,021 | A | 11/1984 | Schaefer et al. | |
| 4,529,834 | A | 7/1985 | Nattel | |
| 4,544,219 | A | 10/1985 | Barkas | |
| 4,603,932 | A | 8/1986 | Heverly | |
| 4,714,858 | A | 12/1987 | Sanders | |
| 4,722,693 | A | 2/1988 | Rose | |
| 4,867,693 | A | 9/1989 | Gizienski et al. | |
| 4,867,694 | A | 9/1989 | Short | |
| 4,897,049 | A | 1/1990 | Miller et al. | |
| 4,909,749 | A | 3/1990 | Long | |
| 4,936,789 | A | 6/1990 | Ugalde | |
| 5,006,075 | A | 4/1991 | Bowden, Jr. | |
| 5,020,997 | A | 6/1991 | Calderara et al. | |
| 5,066,238 | A | 11/1991 | Shieh | |

(Continued)

FOREIGN PATENT DOCUMENTS

| | | |
|---|---|---|
| GB | 2396489 | 6/2004 |
| WO | WO 00/17728 | 3/2000 |

*Primary Examiner* — Alexander Gilman
(74) *Attorney, Agent, or Firm* — Carter, DeLuca, Farrell & Schmidt, LLP

(57) ABSTRACT

A platform and slider assembly for use in a tamper resistant receptacle is provided. The tamper resistant receptacle includes a cover having first and second non-grounding apertures formed therein. In use, when a set of blades of a plug is inserted simultaneously through the first and second apertures formed in the cover, the blades make contact with the at least one angled surface on the slider urging the at least one angled surface of the slider to move with respect to the angled surface of the platform such that the slider is urged from the first position to the second position. The first and second apertures formed in the platform define an axis extending from the first aperture to the second aperture; and the slider moves relative to the platform in a direction orthogonal to the axis extending from the first aperture to the second aperture.

14 Claims, 22 Drawing Sheets

U.S. PATENT DOCUMENTS 5,069,630 A 12/1991 Tseng et al.
5,277,607 A 1/1994 Thumma et al.
5,320,545 A 6/1994 Brothers
5,374,199 A 12/1994 Chung
5,391,085 A 2/1995 Tigner
5,518,132 A 5/1996 Chen
5,551,884 A 9/1996 Burkhart, Sr.
5,702,259 A * 12/1997 Lee ..... 439/137
5,839,909 A 11/1998 Calderara et al.
5,846,092 A 12/1998 Feldman et al.
5,902,140 A 5/1999 Cheung et al.
5,915,981 A 6/1999 Mehta
6,086,391 A 7/2000 Chiu
6,111,210 A 8/2000 Allison
6,149,446 A 11/2000 Yu
6,217,353 B1 4/2001 Yu-Tse
6,224,401 B1 5/2001 Yu
6,238,224 B1 5/2001 Shao
6,299,487 B1 10/2001 Lopata et al.
6,422,880 B1 7/2002 Chiu
6,537,088 B2 3/2003 Huang
6,537,089 B1 3/2003 Montague
6,734,769 B1 5/2004 Germain et al.
6,749,449 B2 6/2004 Mortun et al.
6,767,228 B2 * 7/2004 Katz ..... 439/140
6,776,630 B1 8/2004 Huang
6,786,745 B1 9/2004 Huang
6,873,231 B2 3/2005 Germain et al.
6,884,111 B2 4/2005 Gorman
6,893,275 B2 5/2005 Ng et al.
6,896,530 B2 5/2005 Nishio et al.
6,932,631 B2 * 8/2005 Huang ..... 439/145
6,943,297 B2 9/2005 Capella
6,949,994 B2 9/2005 Germain et al.
6,963,260 B2 11/2005 Germain et al.
6,969,801 B2 11/2005 Radosavljevic et al.
6,979,212 B1 12/2005 Gorman
6,986,674 B1 1/2006 Gorman
7,026,895 B2 4/2006 Germain et al.
7,088,205 B2 8/2006 Germain et al.
7,088,206 B2 8/2006 Germain et al.
7,114,968 B2 10/2006 Healy
7,129,413 B1 10/2006 Rao et al.
7,179,992 B1 2/2007 Packard et al.
7,227,435 B2 6/2007 Germain
7,312,394 B1 12/2007 Weeks et al.
7,312,963 B1 12/2007 Radosavljevic et al.
7,355,117 B2 4/2008 Castaldo et al.
7,439,833 B2 10/2008 Germain et al.
7,452,221 B1 11/2008 Oddsen et al.
7,455,538 B2 * 11/2008 Germain ..... 439/137
7,510,412 B1 3/2009 Valentin
7,588,447 B1 9/2009 Ni
7,724,557 B2 5/2010 Ganta Papa Rao Bla et al.
7,820,909 B2 * 10/2010 Castaldo et al. ..... 174/53
8,062,072 B2 * 11/2011 Ziobro ..... 439/650
8,063,303 B1 11/2011 McBain
8,242,362 B2 * 8/2012 Castaldo et al. ..... 174/53
2002/0097546 A1 7/2002 Weinberger
2004/0203270 A1 10/2004 Wang
2006/0181373 A1 8/2006 Germain et al.
2007/0049077 A1 3/2007 Germain et al.
2007/0049079 A1 3/2007 Nalwad et al.
2007/0111569 A1 5/2007 Germain et al.
2007/0211397 A1 * 9/2007 Sokolow et al. ..... 361/42
2008/0156512 A1 * 7/2008 Castaldo et al. ..... 174/53
2008/0248662 A1 10/2008 Bazayev et al.
2009/0032278 A1 2/2009 Weeks et al.
2009/0227130 A1 9/2009 Carbone et al.
2009/0286411 A1 * 11/2009 Bazayev et al. ..... 439/145

* cited by examiner

TAMPER RESISTANT ELECTRICAL WIRING DEVICE SYSTEM

FIELD OF THE INVENTION

1. Technical Field

The present invention relates to electrical receptacles, and, more particularly, to a tamper-resistant electrical wiring device system.

2. Background of the Invention

Electrical power transmitted from a source to a point of use through an electrical distribution system within a home or a commercial building for equipment and operations is a beneficial service. Conventional electrical receptacles within such a distribution system include a pair of slots or apertures aligned with contacts, wherein blades of an electric plug may be inserted in the pair of apertures to directly engage contacts within the receptacle in an effort to facilitate a desired electrical connection. Since a large percentage of these receptacles are used in residential buildings and are located near the floor, it may be beneficial to provide added protection when a young child or infant may come into contact with a receptacle. For example, a small object inserted into either one of the apertures potentially may result in electrical shock.

Children may insert into receptacles a wide variety of objects made of conductive material including but not limited to metal articles. Most objects may be everyday household and easily accessible items such as, paper clips, pens wire tools, hairpins, safety pins, keys, forks, knives, screws, nails, tweezers and coins.

Both scenarios present circumstances to be avoided, where possible. As such, the issue of human safety and avoiding hazards has always been considered by the owner of the instant application in developing new products. Further, in an effort to eliminate the foregoing, the National Electrical Code (NEC) now requires tamper-proof electrical receptacles in pediatric environments. A National Electrical Manufacturer's Association (NEMA) task force has concluded that every residential building should be required to have tamper-resistant electrical receptacles and ground fault circuit interrupters (GFCI) designed within the electrical distribution system throughout the home.

SUMMARY

The embodiments of the present disclosure advance the state of the art of tamper-resistant electrical receptacles by providing a platform and slider assembly for use in a tamper-resistant electrical receptacle which does not require that blades of a plug pass through apertures formed in the slider to establish electrical contact but rather that the slider moves to a position in which the slider does not block the set of apertures formed in the cover but moves laterally with respect to the set of apertures formed in the platform.

Thus, the embodiments of the present disclosure provide a simple, effective, efficient, low-cost electrical receptacle that is tamper-proof. This device must prevent electric shock when one inserts a conductive instrumentality other than the plug of an appliance, while still permitting full surface contact between the plug blades and contacts and frequent insertion and removal of blades.

In one embodiment of the present disclosure, a platform and slider assembly for use in a tamper resistant receptacle is provided. The tamper resistant receptacle includes a cover having first and second non-grounding apertures formed therein. The platform and slider assembly comprises a platform having a base surface, at least part of said base surface including an angled surface, the platform including first and second apertures adapted and configured for enabling passage of a set of blades in a plug to enable the set of blades to establish contact with corresponding contacts in the tamper resistant receptacle; a slider reciprocally disposed adjacent the platform, the slider defining at least one angled surface, wherein the at least one angled surface of the slider cooperates with the angled surface of the platform, the slider being movable between a first position in which the slider blocks the first and second apertures formed in the cover and a second position in which the slider does not block the first and second apertures formed in the cover; and a biasing member operatively associated with the slider for biasing the slider to the first position.

In use, when a set of blades of a plug is inserted simultaneously through the first and second apertures formed in the cover, the blades make contact with the at least one angled surface on the slider urging the at least one angled surface of the slider to move with respect to the angled surface of the platform such that the slider is urged from the first position to the second position.

Also, during movement to the second position, the slider moves in a direction wherein at least portions of the first and second defined by the platform are simultaneously cleared from obstruction by the slider to enable the set of blades to move through the first and second apertures formed in the cover and through the first and second apertures formed in the platform to establish contact with the corresponding contacts in the tamper resistant receptacle.

The first and second apertures formed in the platform define an axis extending from the first aperture to the second aperture; and the slider moves relative to the platform in a direction orthogonal to the axis extending from the first aperture to the second aperture.

According to another embodiment, a platform and slider assembly for use in a tamper resistant receptacle is provided. The tamper resistant receptacle includes a cover having first and second apertures and a ground opening. The platform and slider assembly includes a platform having a base surface, at least part of said base surface including an angled surface, the platform defining first and second apertures therein to enable passage therethrough of a set of blades in a plug to enable the set of blades to establish contact with corresponding contacts in the tamper resistant receptacle; a slider reciprocally disposed adjacent the platform, the slider defining at least one angled surface, wherein the at least one angled surface of the slider cooperates with the angled surface of the platform, the slider being movable between a first position in which the slider blocks the first and second apertures formed in the cover and a second position in which the slider does not block the first and second apertures formed in the cover; and a biasing member operatively associated with the slider for biasing the slider to the first position.

When a set of blades in a plug is inserted simultaneously through the first and second apertures formed in the cover, the blades make contact with the at least one angled surface on the slider urging the at least one angled surface of the slider to move with respect to the angled surface of the platform such that the slider is urged from the first position to the second position.

In use, in the second position, the slider has moved to a position enabling the set of blades to move directly through the first and second apertures of the cover directly through the first and second apertures defined in the platform to establish contact with the corresponding contacts in the tamper resistant receptacle.

The first and second apertures defined by the platform define an axis extending from the first aperture to the second aperture, and the slider moves relative to the platform in a direction orthogonal to the axis extending from the first aperture to the second aperture, wherein motion of the slider in a direction orthogonal to the axis causes the slider to move in a direction wherein at least portions of the first and second apertures defined by the platform are simultaneously cleared from obstruction by the slider to enable the set of blades to move through the first and second apertures formed in the cover and through the first and second apertures defined in the platform to establish contact with the corresponding contacts in the tamper resistant receptacle.

According to yet another embodiment of the present disclosure, a slider for use in a tamper resistant receptacle is provided. The receptacle includes a cover having first and second apertures, the cover defining a reference plane. The slider comprises a body portion of the slider defining at least a first surface and a second surface, opposite the first surface; and at least one angled surface provided in or on the second surface of the body portion. The at least one angled surface is configured to selectively engage a surface of the receptacle when the slider is moved in a direction orthogonal to the reference plane defined by the cover to urge the slider in a transverse direction relative to the cover from a first position in which the slider blocks the first and second apertures formed in the cover to a second position in which the slider does not block the first and second apertures formed in the cover.

BRIEF DESCRIPTION OF THE DRAWINGS

For a more complete understanding of the invention according to the present disclosure and the advantages thereof, reference is now made to the following description taken in conjunction with the accompanying drawings in which like reference numbers indicate like features and wherein.

DETAILED DESCRIPTION

Figure 1:
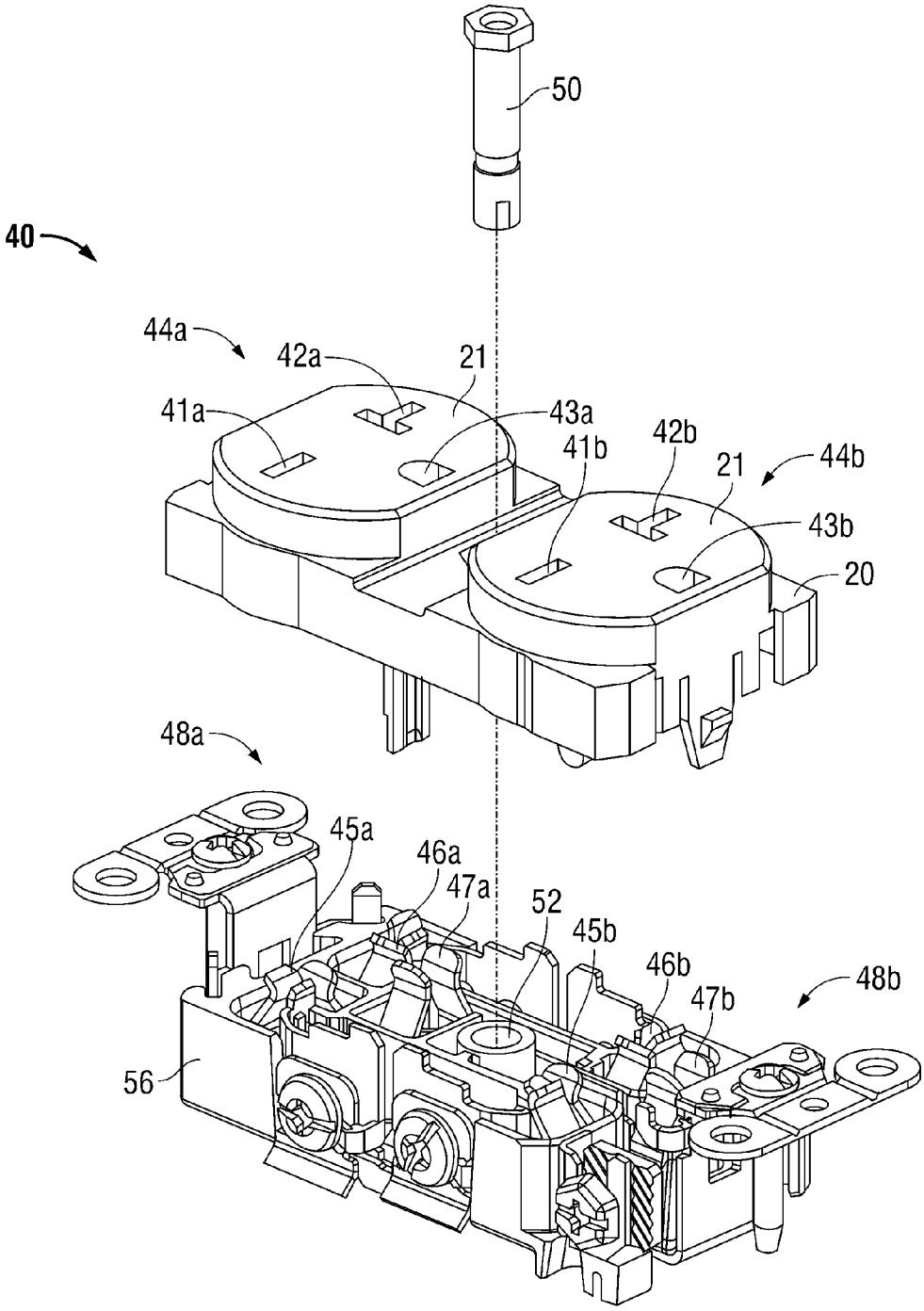
FIG. 1 is an exploded view of a NEMA 6-20 tamper-resistant duplex electrical receptacle that is adapted to accommodate a platform and slider assembly wherein the slider moves to a position to enable a set of blades to establish contact with corresponding contacts in the tamper-resistant assembly through a set of apertures in the platform according to one embodiment of the present disclosure.

The embodiments of the present disclosure will now be described with reference to the aforementioned drawings, wherein like numerals refer to like parts. More particularly, the invention according to the present disclosure will now be described more fully hereinafter with reference to the accompanying drawings, in which various embodiments are shown but which may, however, be embodied in many different forms and should not be construed as limited to the embodiments set forth herein. Rather, these embodiments are provided so that this disclosure will be thorough and complete, and will fully convey the scope of the invention of the present disclosure to those skilled in the art.

Specifically, in accordance with one embodiment of the present disclosure, a platform and slider assembly is for use in a tamper resistant receptacle wherein the tamper resistant receptacle includes a cover having at least a set of apertures formed therein. The platform and slider assembly includes a platform defining a cavity having a base surface within the cavity. At least part of the base surface includes an angled surface. The platform defines at least two apertures therein to enable passage therethrough of a set of blades in a plug to enable the set of blades to establish contact with corresponding contacts in the tamper resistant assembly. A slider is reciprocally disposed within the cavity of the platform. The slider defines at least one angled surface. The angled surface of the slider cooperates with the inclined plane of the platform. The slider is movable between a first position in which the slider blocks the set of apertures formed in the cover and a second position in which the slider does not block the set of apertures formed in the cover. It is understood herein that the set of apertures constitute the live apertures and not the opening or aperture for the ground pin (however, in other embodiments, the set of apertures may also include the aperture for the ground pin without departing from the spirit of the invention).

Typically when a plug, such as a two blade plug, is inserted into a receptacle, both blades will be inserted in the receptacle at the same time. In the discussion below, this is referred to as simultaneous, or substantially simultaneous, insertion. This is meant to describe the normal operation of inserting a plug into a receptacle and is not meant to require that the blades must be inserted into the receptacle at the same exact instant in time. For example, one blade may be slightly longer than the other due to manufacturing tolerances or the plug may be inserted at a slight angle. If this occurs, one blade may be inserted into the receptacle slightly before or after the other blade without departing from the spirit of the invention.

When a set of blades in a plug is inserted substantially simultaneously through the set of apertures formed in the cover, the blades make contact with a surface on the slider urging the angled surface of the slider to cam against the angled surface of the platform such that the slider is urged from the first position to the second position. During movement to the second position, the slider moves in a direction wherein at least portions of the at least two apertures defined by the platform are simultaneously cleared from obstruction by the slider to enable the set of blades to move through the set of apertures of the cover and through the at least two apertures defined in the platform to establish contact with the corresponding contacts in the tamper resistant receptacle. Thereby, the electrical receptacle in conjunction with the platform and slider assembly effectively reduces the possibility of electric shock while reducing the probability of blockage of the receptacle for a proper insertion of a pair of blades into the apertures formed in the cover.

This application relates to U.S. Pat. No. 7,355,117 B2 by Castaldo et al., "TAMPER-RESISTANT ELECTRICAL WIRING DEVICE SYSTEM", issued Apr. 8, 2008 and to U.S. Pat. No. 7,820,909 B2 by Castaldo et al., "TAMPER-RESISTANT ELECTRICAL WIRING DEVICE SYSTEM", issued Oct. 26, 2010, the entire contents of both of which are incorporated herein by reference.

FIG. 1 illustrates an exploded view of one embodiment of a tamper-resistant duplex electrical receptacle 40 that is adapted to accommodate a platform and slider assembly according to embodiments of the present disclosure. NEMA Standard No. WD6 sets outs dimensional standards of the configurations of wiring devices used in the electrical industry. For example, the NEMA configuration of the receptacle of FIG. 1 is NEMA 6-20. It should be noted that although a NEMA 6-20 configuration is shown, the present embodiments may be used with any suitable NEMA configuration such as, but not limited to NEMA 1-15, 2-15, 5-15, 5-20, 5-30, 5-50, 6-15, 6-20, 6-30, and 6-50. The tamper resistant receptacle 40 includes a cover 20 having at least a set of apertures formed therein. More particularly, the cover 20 includes a first set of apertures 41*a* and 42*a* plus a ground aperture 43*a* that form a first single receptacle 44*a* and a second set of apertures 41*b* and 42*b* plus a ground aperture 43*b* that form a second single receptacle 44*b*, the first and second receptacles 44*a* and 44*b*, respectively, forming the duplex receptacle 40.

The receptacle 40 includes a base or base assembly 56 that is configured to receive the cover 20. The base or base assembly 56 includes a first set of contacts 48*a* that include contacts 45*a* and 46*a* that correspond to apertures 41*a* and 42*a*, respectively, and contacts 47*a* that correspond to ground aperture 43*a* in the cover 20. The base 56 also includes a second set of contacts 48*b* that include contacts 45*b* and 46*b* that correspond to apertures 41*b* and 42*b*, respectively, and contacts 47*b* that correspond to ground aperture 43*b* in the cover 20.

A connecting bolt or screw 50 is positioned to fasten or couple the cover 20 to the base or base assembly 56 to be received by an aperture 52 in the base 56. A corresponding aperture in the cover 20 for passage of the connecting bolt or screw 50 is not shown.

Figure 2:
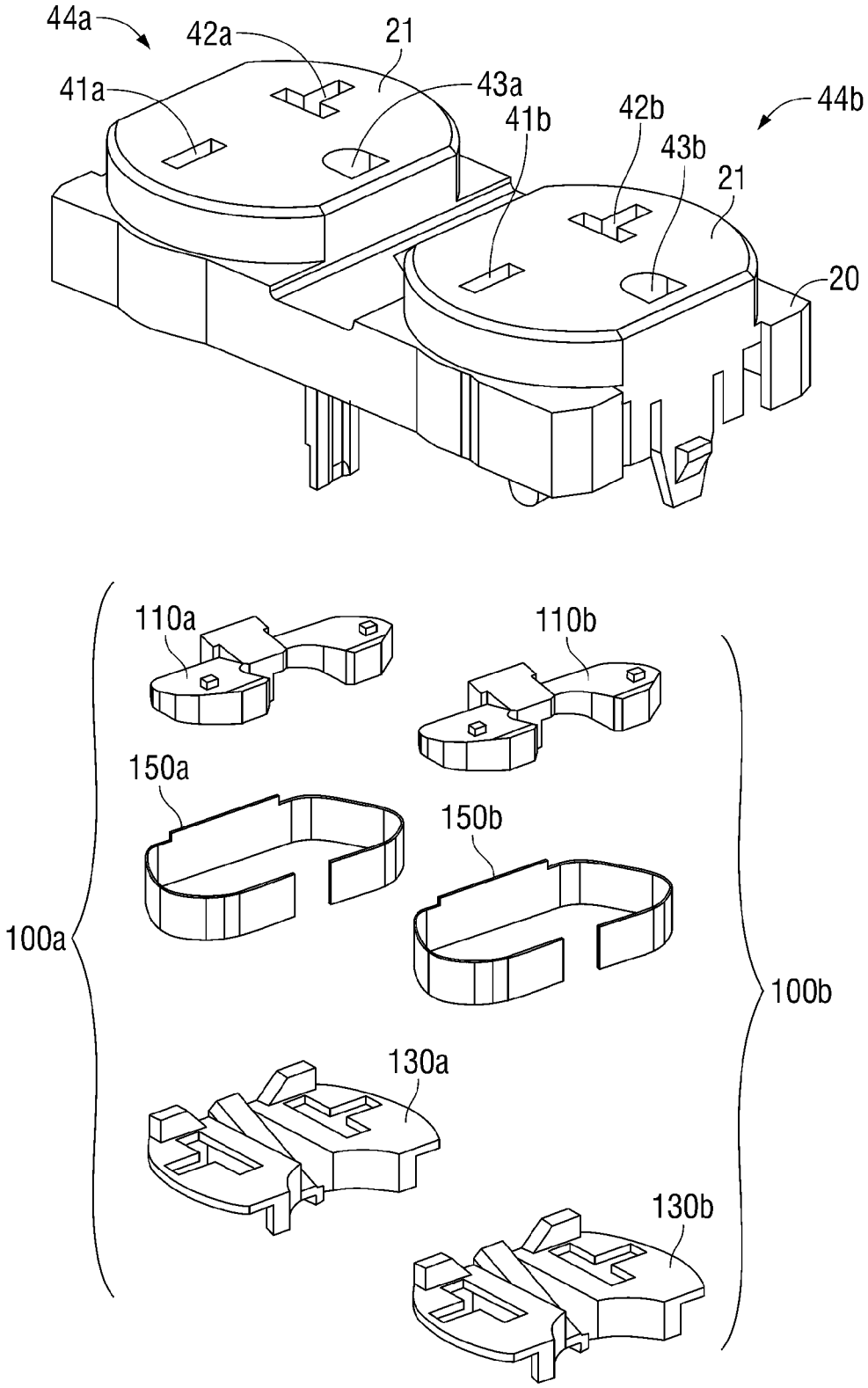
FIG. 2 is an exploded view of the cover of the tamper-resistant duplex electrical receptacle of FIG. 1 including exploded views of first and second platform and slider assemblies wherein the slider of each platform and slider assembly moves to a position to enable a set of blades to establish contact with corresponding contacts in the tamper-resistant receptacle through a set of apertures in the platform.

FIG. 2 is an exploded view of the cover 20 of the tamper-resistant duplex electrical receptacle 40 of FIG. 1 including exploded views of first platform and slider assembly 100*a* and second platform and slider assembly 100*b*. The cover 20 includes an exterior surface 21. The first platform and slider assembly 100*a* includes a slider 110*a*, a corresponding platform 130*a* and a corresponding biasing member 150*a*, e.g., a band or leaf spring as shown, for biasing the slider 110*a* from a second position to a first position as explained below. Similarly, the second platform and slider assembly 100*b* includes a slider 110*b*, a corresponding platform 130*b* and a corresponding biasing member 150*b*, e.g., a band or leaf spring as shown, for biasing the slider 110*b* from a second position to a first position again as explained below. Other types of suitable biasing members may be used including, but are not limited to, coil springs. The biasing members recover the energy of motion of the sliders and return the sliders to their original position as explained below.

The first platform and slider assembly 100*a* is configured and disposed within the receptacle 40 such that the slider 110*a* is movable between a first position in which the slider 110*a* blocks corresponding set of apertures 44*a* formed in the cover 20 and a second position in which the slider 110*a* does not block the corresponding set of apertures 44*a* formed in the cover 20.

Similarly, the second platform and slider assembly 100*b* is configured and disposed within the receptacle 40 such that the slider 110*b* is movable between a first position in which the slider 110*b* blocks corresponding set of apertures 44*b* formed in the cover 20 and a second position in which the slider 110*b* does not block the corresponding set of apertures 44*b* formed in the cover 20.

Those skilled in the art will recognize that a power plug (not shown) typically includes a plurality of prongs or blades, of which generally at least two of which are live (phase/neutral) and, optionally, a third of which is a ground. The blades are inserted through the power apertures 41*a* and 42*a* or 41*b* and 42*b* to conduct electrical power from or to the receptacle 40 while the ground or neutral prong is inserted through ground or neutral apertures 43*a* or 43*b* to establish a ground connection for the device (not shown) which is being supplied electrical power from the receptacle 40.

The movement of the sliders 110*a* and 110*b* with respect to the respective platforms 130*a* and 130*b* is explained in more detail below.

Figure 3:
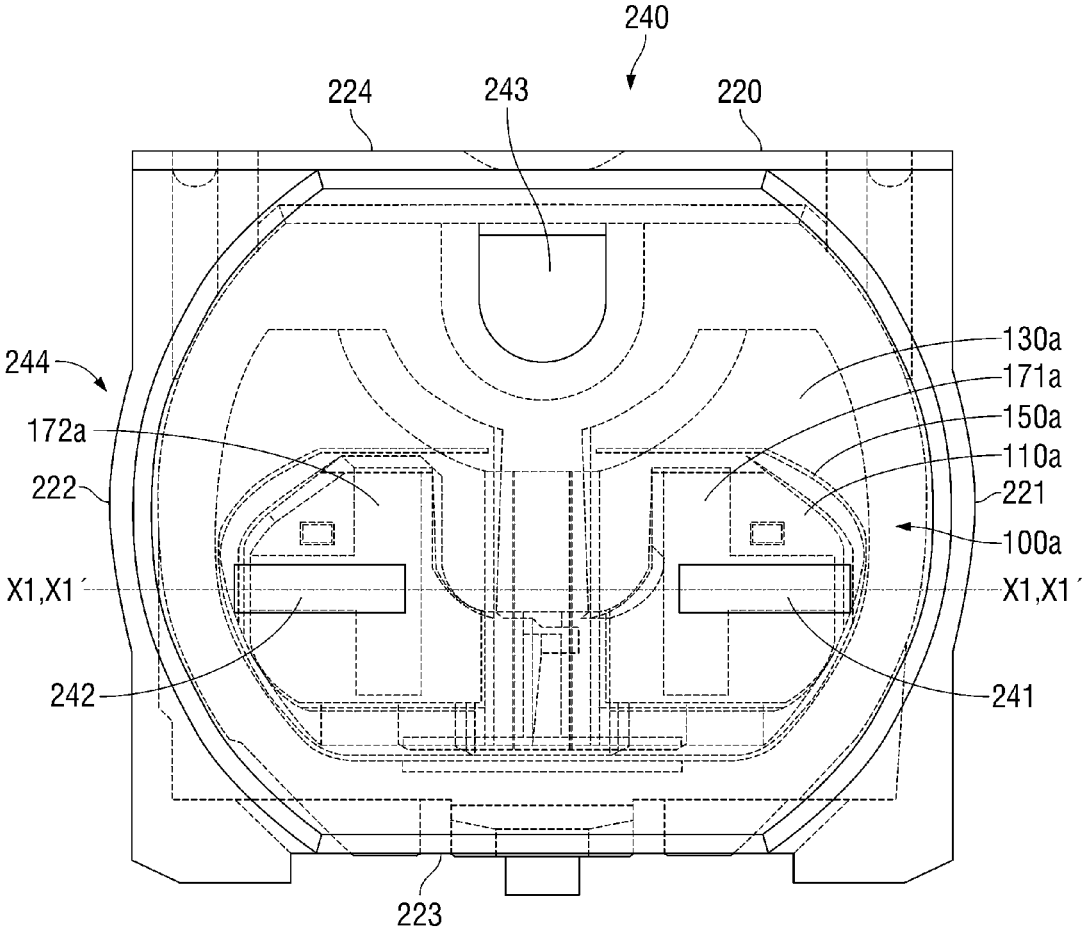
FIG. 3 is a front view of a NEMA 6-15 tamper-resistant single receptacle that may include the platform and slider assembly according to one embodiment of the present disclosure.

FIG. 3 is a front view of a NEMA 6-15 tamper-resistant single receptacle 240 that includes the platform and slider assembly 100*a* (or 100*b*) and a corresponding set of apertures 244 that includes blade receiver apertures 241 and 242 and ground aperture 243 formed in cover 220 according to one embodiment of the present disclosure.

Figure 4:
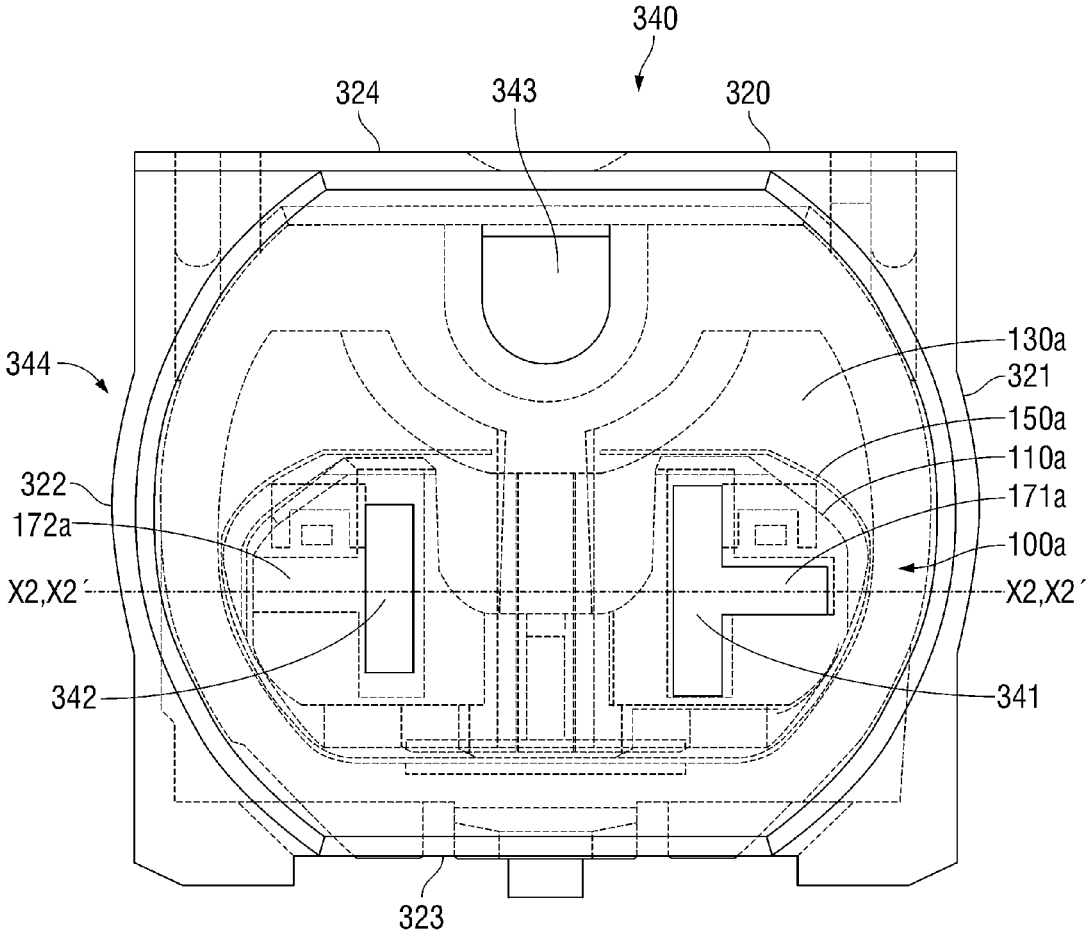
FIG. 4 is a front view of a NEMA 5-20 tamper-resistant single receptacle that includes the platform and slider assembly according to one embodiment of the present disclosure.

FIG. 4 is a front view of a NEMA 5-20 tamper-resistant single receptacle 340 that includes the platform and slider assembly 100*a* (or 100*b*) and a corresponding set of apertures 344 that includes blade receiver apertures 341 and 342 and ground aperture 343 formed in cover 320 according to one embodiment of the present disclosure.

Figure 5:
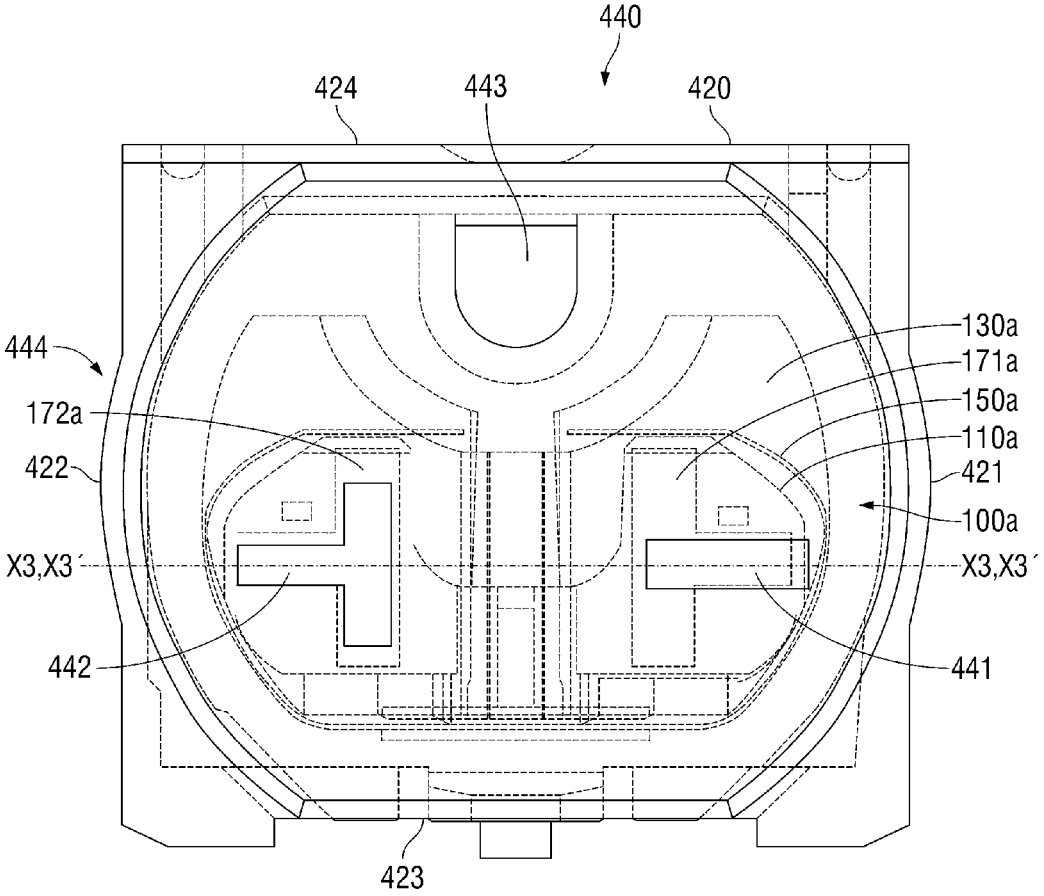
FIG. 5 is a front view of a NEMA 6-20 tamper-resistant single receptacle that includes the platform and slider assembly according to one embodiment of the present disclosure.

In a like manner as illustrated in FIGS. 3 and 4, FIG. 5 is a front view of a NEMA 6-20 tamper-resistant single receptacle 440 that includes the platform and slider assembly 100*a* (or 100*b*) and a corresponding set of apertures 444 that includes blade receiver apertures 441 and 442 and ground aperture 443 formed in cover 420 according to one embodiment of the present disclosure.

Figure 6:
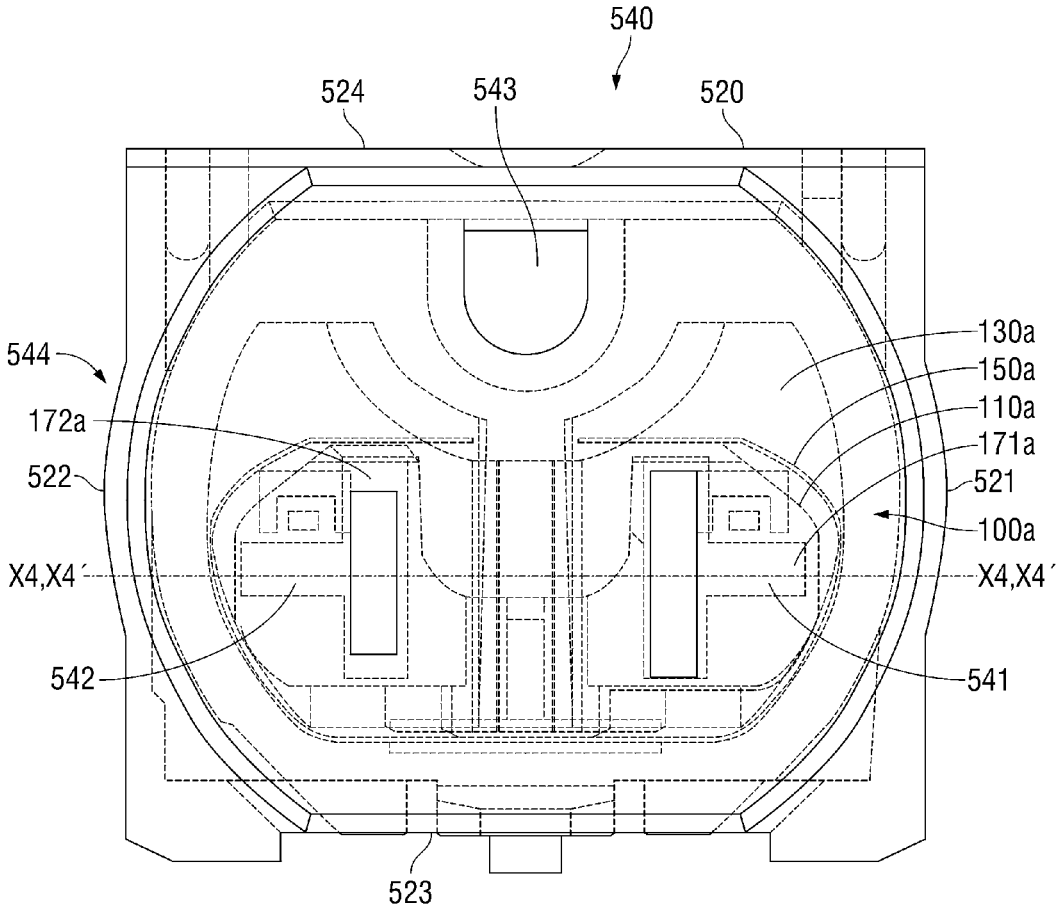
FIG. 6 is a front view of a NEMA 5-15 tamper-resistant single receptacle that includes the platform and slider assembly according to one embodiment of the present disclosure.

Similarly, FIG. 6 is a front view of a NEMA 5-15 tamper-resistant single receptacle 540 that includes the platform and slider assembly 100*a* (or 100*b*) and a corresponding set of apertures 544 that includes blade receiver apertures 541 and 542 and ground aperture 543 formed in cover 520 according to one embodiment of the present disclosure.

Figure 7:
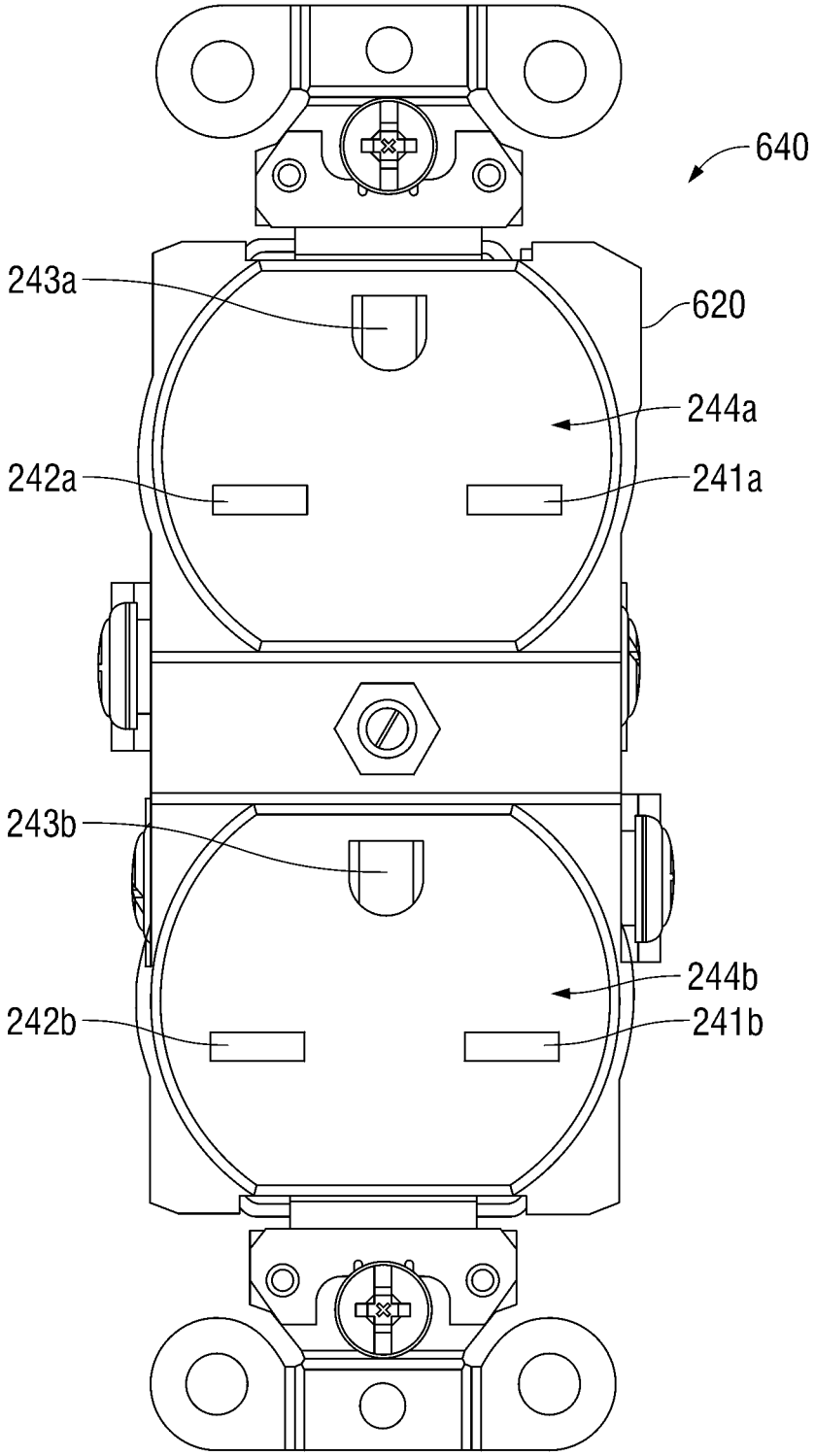
FIG. 7 is a front view of a NEMA 6-15 tamper-resistant duplex receptacle that includes the platform and slider assembly according to one embodiment of the present disclosure.

FIG. 7 is a front view of a NEMA 6-15 tamper-resistant duplex receptacle 640 that includes the platform and slider assembly (not shown) and first and second sets of apertures 244*a* and 244*b* (see apertures 244 of FIG. 3), respectively, formed in cover 620 according to one embodiment of the present disclosure. First aperture set 244*a* includes first and second blade receiver apertures 241*a* and 242*a*, respectively, and ground aperture 243*a* formed in cover 220. Similarly, second aperture set 244*b* includes first and second blade receiver apertures 241*b* and 242*b*, respectively, and ground aperture 243*b* formed in cover 220.

Figure 8:
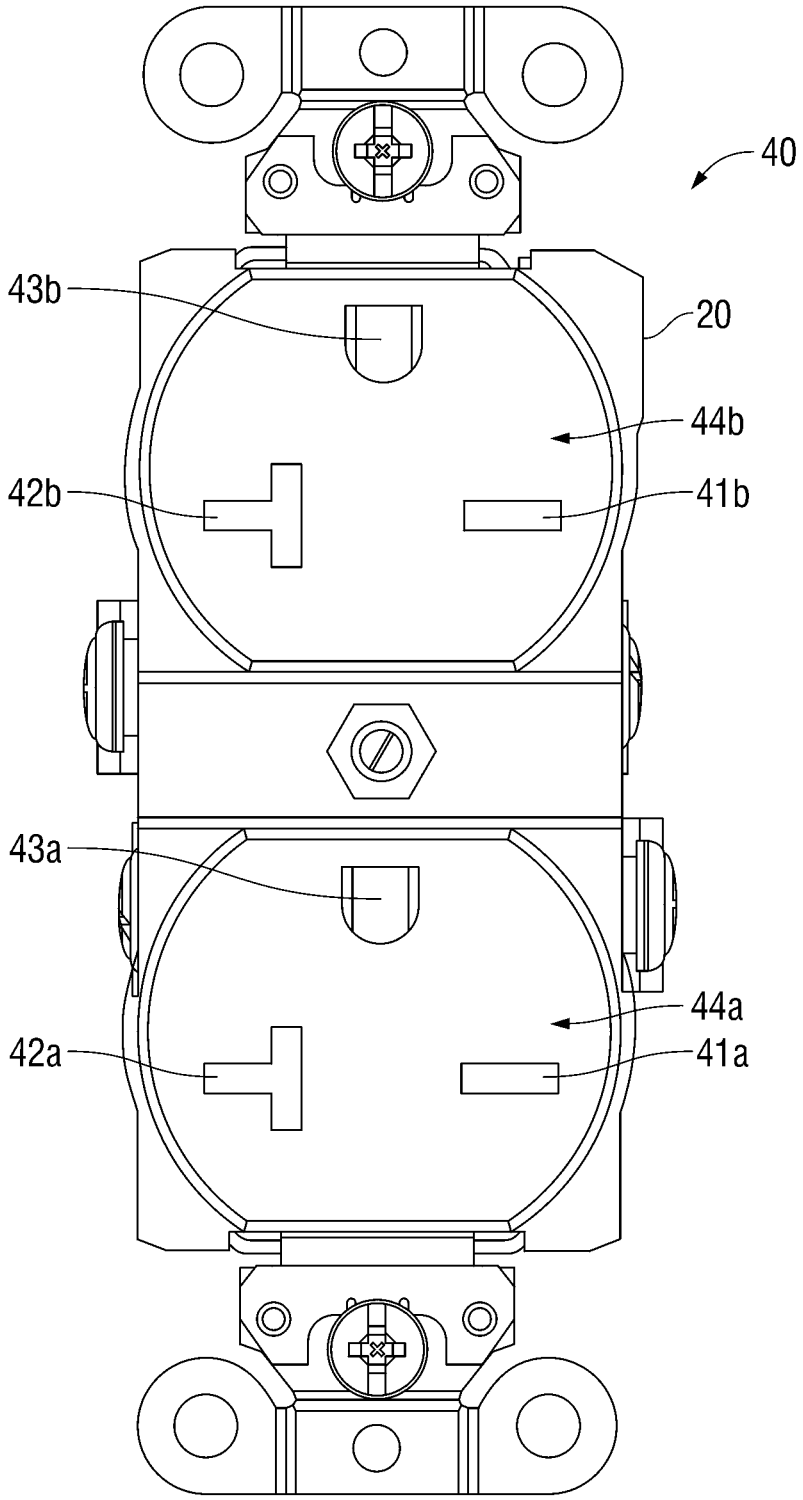
FIG. 8 is a front view of the NEMA 6-20 tamper-resistant duplex receptacle that includes the platform and slider assembly according to one embodiment of the present disclosure.

Similarly, FIG. 8 is a front view of the NEMA 6-20 tamper-resistant duplex receptacle 40 illustrated in FIGS. 1 and 2 that includes the platform and slider assemblies (not shown) and first and second sets of apertures 44*a* and 44*b*, respectively, formed in the cover 20 according to one embodiment of the present disclosure. First aperture set 44*a* includes first and second blade receiver apertures 41*a* and 42*a*, respectively, and ground aperture 43*a* formed in cover 220. Similarly, second aperture set 44*b* includes first and second blade receiver apertures 41*b* and 42*b*, respectively, and ground aperture 43*b* formed in cover 20.

Figure 9:
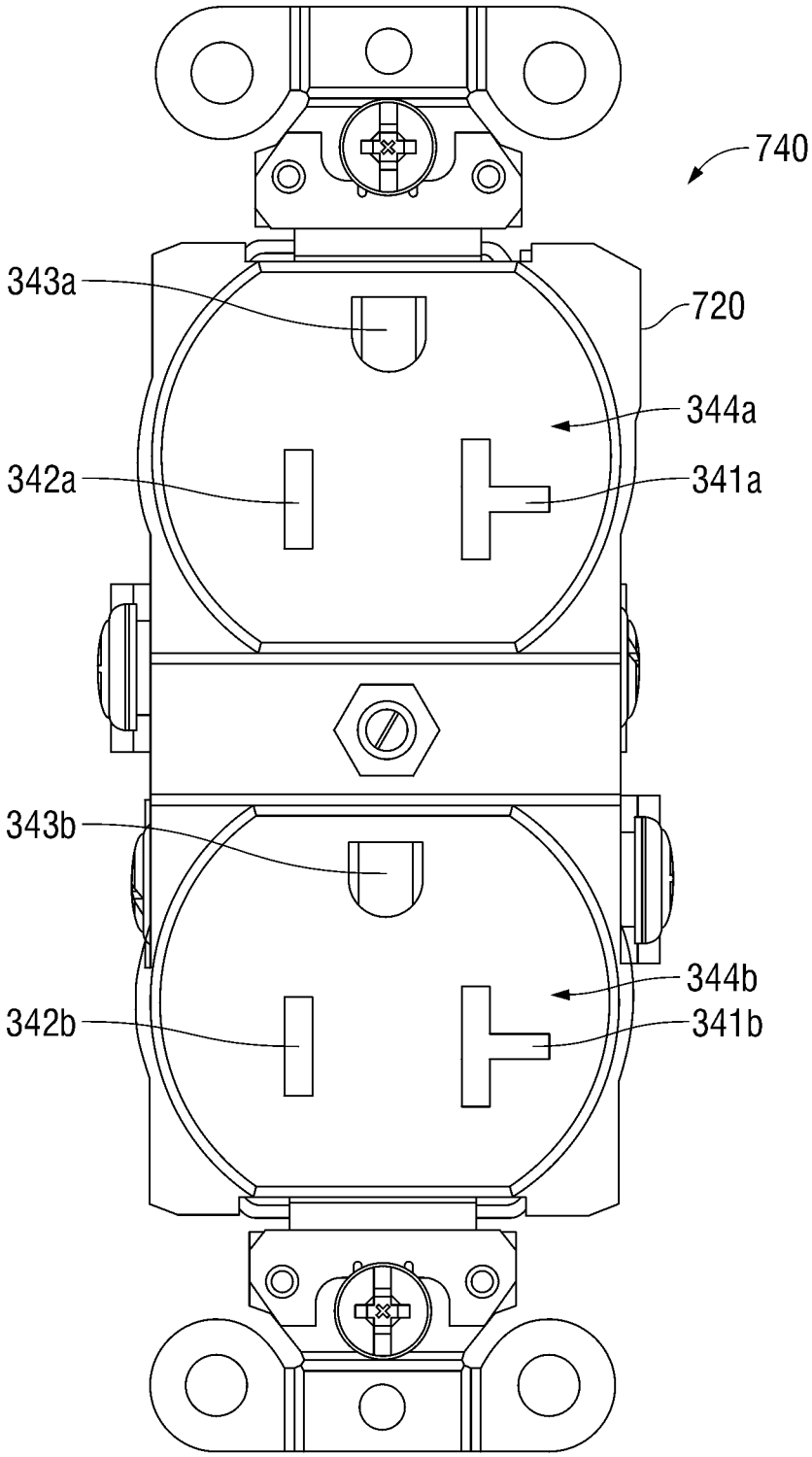
FIG. 9 is a front view of a NEMA 5-20 tamper-resistant duplex receptacle that includes the platform and slider assembly according to one embodiment of the present disclosure.

Likewise, FIG. 9 is a front view of a NEMA 5-20 tamper-resistant duplex receptacle 740 that includes the platform and slider assemblies (not shown) and first and second sets of apertures 344*a* and 344*b* (see apertures 344 of FIG. 4), respectively, formed in the cover 720 according to one embodiment of the present disclosure. First aperture set 344*a* includes first and second blade receiver apertures 341*a* and 342*a*, respectively, and ground aperture 343*a* formed in cover 720. Similarly, second aperture set 344*b* includes first and second blade receiver apertures 341*b* and 342*b*, respectively, and ground aperture 343*b* formed in cover 220.

Figure 10:
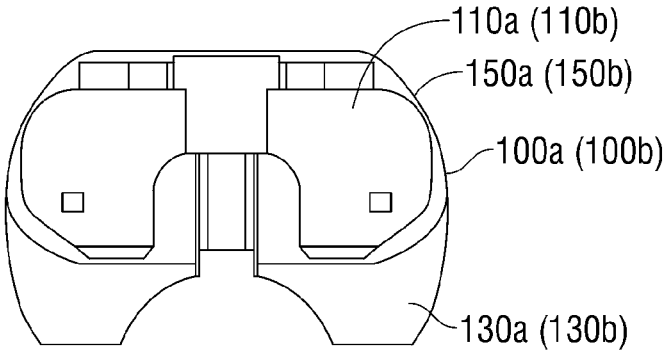
FIG. 10 is a top view of the platform and slider assembly according to one embodiment of the present disclosure wherein the slider moves to a position to enable a set of blades to establish contact with corresponding contacts in the tamper-resistant assembly through a set of apertures in the platform.

FIG. 10 is a top view of the platform and slider assembly 100*a* (or 100*b*) of FIG. 2 that includes slider 110*a* (or 110*b*), corresponding platform 130*a* (or 130*b*) and corresponding biasing member 150*a* (or 150*b*) for biasing the slider 110*a* (110*b*) into first and second positions as explained below.

Figure 11:
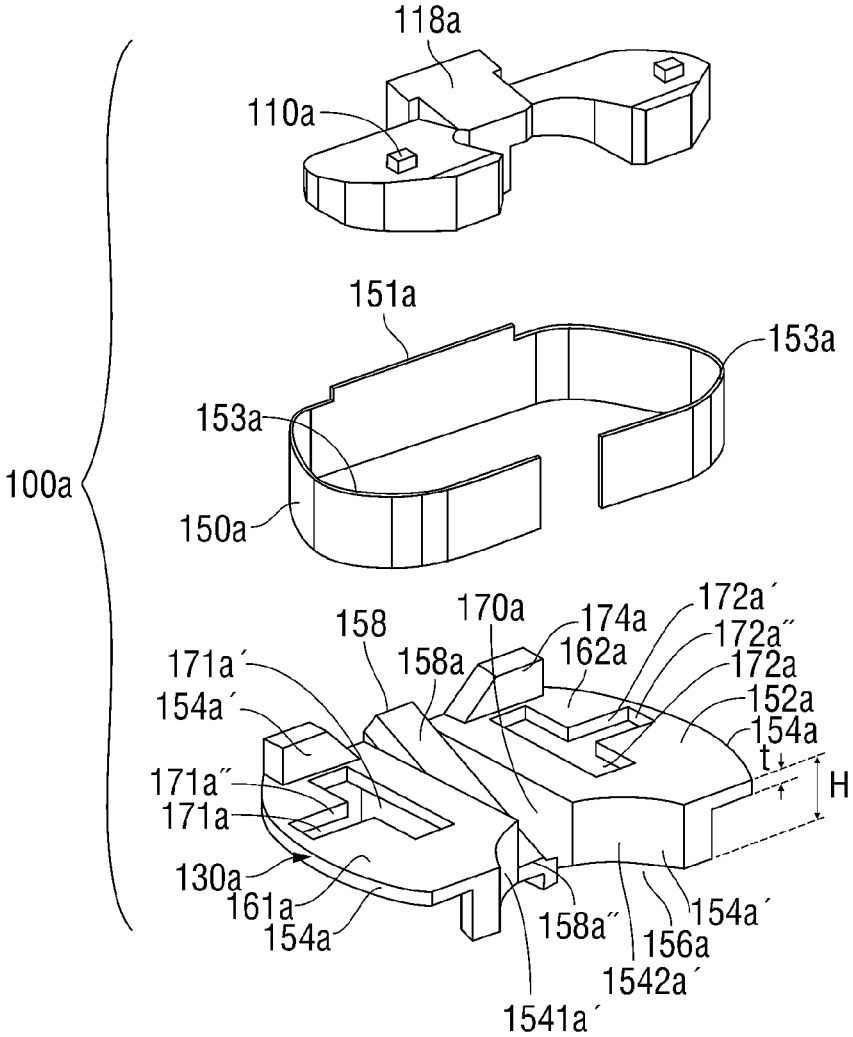
FIG. 11 is a perspective fully exploded view of the platform and slider assembly including a biasing member for biasing the slider to a position in which the slider blocks the set of apertures formed in the cover according to one embodiment of the present disclosure.

FIG. 11 is an exploded perspective view of the platform and slider assembly 100*a*, as originally illustrated in (or 100*b*, not shown) FIG. 2, including the biasing member 150*a* (or 150*b*, not shown) for biasing the slider 110*a* (or 110*b*, not shown) to a position in which the slider blocks the set of apertures 44*a* (or 44*b*) formed in the cover 20 according to one embodiment of the present disclosure.

Figure 12:
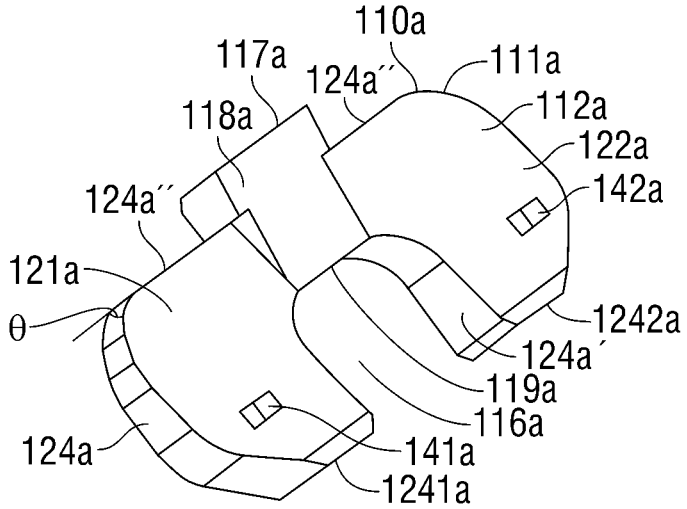
FIG. 12 is a first perspective view of the slider.
Figure 13:
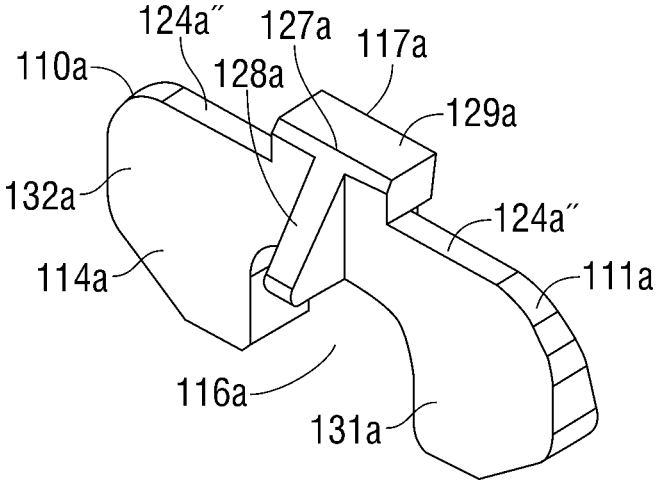
FIG. 13 is a second perspective view of the slider.

FIG. 12 is a perspective view, illustrating an upper surface 112*a* (or 112*b*) of the slider 110*a* (or 110*b*), and FIG. 13 is a perspective view, illustrating a lower surface 114*a* (or 114*b*) of the slider 110*a* (or 110*b*).

Figure 14:
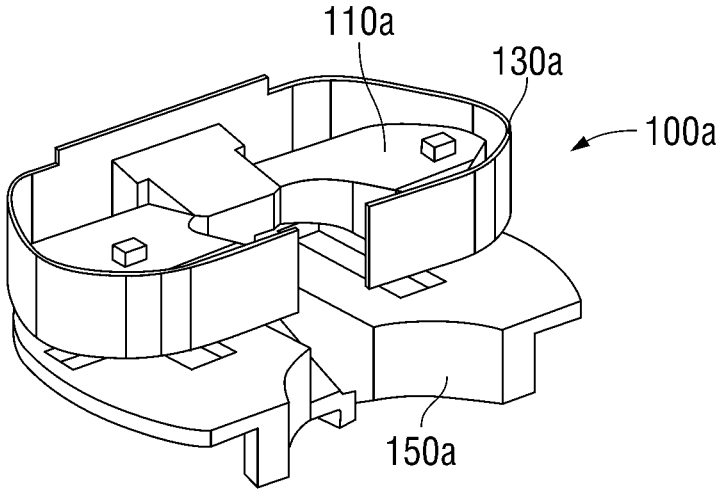
FIG. 14 is a perspective partially exploded view of the platform and slider assembly that includes the biasing member for biasing the slider to the position in which the slider blocks the set of apertures formed in the cover according to one embodiment of the present disclosure.

FIG. 14 is a perspective partially exploded view of the platform and slider assembly 100*a* (or 100*b*) that includes the biasing member 150*a* (or 150*b*) for biasing the slider 110*a* (or 110*b*) to the position in which the slider 110*a* (or 110*b*) blocks the set of apertures 44*a* (or 44*b*) formed in the cover, e.g., cover 20 of FIG. 2, according to one embodiment of the present disclosure.

As best seen in FIGS. 11-13, the slider 110*a* defines a body portion 111 that has a generally U-shaped configuration that is defined by a peripheral edge 124*a* extending entirely around the slider 110*a* to form a partially enclosed central aperture 116*a* which is configured and disposed to provide clearance for the ground contact 47*a* (or 47*b*) in FIG. 1 of the base 56 for various positions of the slider 110*a* as the slider advances towards and retracts from the ground contact 47*a* (or 47*b*). More particularly, the partially enclosed central aperture 116*a* is defined by a front surface 124*a*' of the peripheral edge 124*a*. Upper surface 112*a* of slider 110*a* further defines an upper central inclined surface or ramp 118*a* that originates at an apex 117*a* (FIGS. 12 and 13) above the upper surface 112*a*. The apex 117*a* also originates at a position that extends outwardly from rear surface 124*a*" of the peripheral edge 124*a*.

The upper ramp 118*a* is inclined downwardly in the direction of the partially enclosed central aperture 116*a* to form a partial boundary 119*a* of the partially enclosed central aperture 116*a*. The upper ramp 118*a* is configured and disposed to divide the upper surface 112*a* into a first blade interface or contact surface 121*a* and a second blade interface or contact surface 122*a*, the first blade interface surface 121*a* and the second blade interface surface 122*a* each being adjacent to the upper ramp 118*a* and on opposite sides thereof.

The first blade interface surface 121*a* and the second blade interface surface 122*a* each define an incline or gradient that increases from the rear surface 124*a*" of the peripheral edge 124*a* to frontal projection surfaces 1241*a* and 1242*a* of the peripheral edge 124*a* that form frontal boundaries for the first and second blade interface surfaces 121*a* and 122*a*, respectively.

Rear planar surface 129*a* extends outwardly from rear surface 124*a*" of the peripheral edge 124*a* and is bounded by the apex 117*a* of upper inclined surface or ramp 118*a*. The apex 117*a* that originates at a position that also extends outwardly from rear surface 124*a*" of the peripheral edge 124*a* forms a first line of intersection with the rear planar surface 129*a*. Slider 110*a* includes a lower central inclined surface or ramp 128*a* extending from a lower surface 114*a* that originates at a second line of intersection 127*a* with the rear planar surface 129*a*. Generally, the two lines of intersection 117*a* and 127*a* are parallel to one another.

In contrast to upper ramp 118*a*, which is inclined downwardly in the direction of the partially enclosed central aperture 116*a*, lower ramp 128*a* is inclined upwardly in the direction of the partially enclosed central aperture 116*a* to further define or extend the surface of the partial boundary 119*a* of the partially enclosed central aperture 116*a*.

In a similar manner as described with respect to upper ramp 118*a*, lower ramp 128*a* is configured and disposed to divide the lower surface 114*a* into a first slider and platform interface surface 131*a* and a second slider and platform interface surface 132*a*, the first slider and platform interface surface 131*a* and the second slider and platform interface surface 132*a* each being adjacent to the lower central inclined surface 128*a* and on opposite sides thereof.

Thus, in view of the inclination or gradient of first and second blade interface surfaces 121*a* and 122*a* compared to the first and second slider and platform interface surfaces 131*a* and 132*a*, such that the first and second slider and platform interface surfaces 131*a* and 132*a* are orthogonal to the rear surface 124*a*" of the peripheral edge 124*a* while the first and second blade interface surfaces 121*a* and 122*a* form an obtuse angle "Θ" (see FIG. 12) with respect to the rear surface 124*a*" of the peripheral edge 124*a*, the slider 110*a* can be characterized generally as a substrate having one side having a planar configuration and another side having an inclined or sloped configuration.

As illustrated in FIG. 12, the upper surface 112*a* of the slider 110*a* includes a first capture element 141*a*, e.g., in the form of a nub (as shown) or the like, positioned on the first blade interface surface 121*a* and a second capture element 142*a*, e.g., in the form of a nub (as shown) or the like, positioned on the second blade interface surface 122*a*.

Figure 14A:
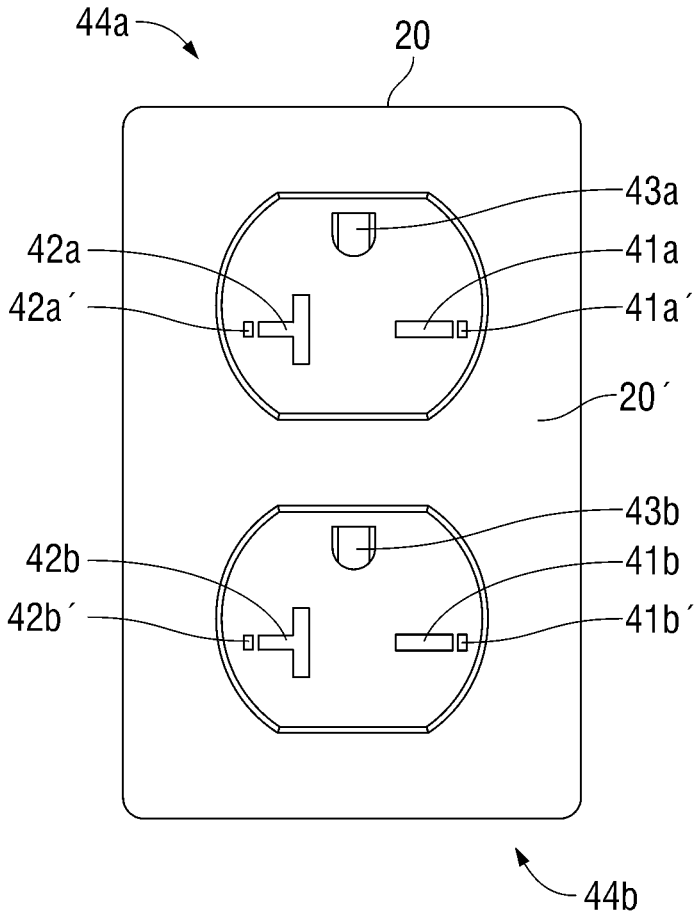
FIG. 14A is a view of the rear side of a cover of the NEMA 6-20 receptacle of FIGS. 1 and 2.

Prior to describing the details of the platform 130*a*, FIG. 14A illustrates a view of the rear side or interior surface 22 of the cover 20 illustrating the first single receptacle 44*a* that includes the first set of apertures 41*a* and 42*a* and the ground aperture 43*a* and the second single receptacle 44*b* that includes the second set of apertures 41*b* and 42*b* and the ground aperture 43*b* of FIG. 1 as viewed from the rear side 22. The rear side 22 of the cover 20 includes first capture element engaging members 41*a*' and 41*b*', e.g., in the form of recesses or the like, in proximity to and adjacent to first apertures 41*a* and 41*b*, respectively. Additionally, the rear side 22 of the cover 20 also includes second capture element engaging members 42*a*' and 42*b*', e.g., in the form of recesses or the like, in proximity to and adjacent to second apertures 42*a* and 42*b*, respectively.

The engagement of the first and second capture elements 141*a* and 142*a* of the slider 110*a* by the first and second capture element engaging members 41*a*' and 42*a*' of the cover 20, respectively, is described in more detail below with respect to FIGS. 22-24.

Returning to FIG. 11, in a manner generally similar to the U-shaped configuration of slider 110*a*, the platform 130*a*, as compared to the slider 110*a*, has a shallow U-shaped generally planar configuration that is defined by a peripheral edge 154*a*. The peripheral edge 154*a* also extends entirely around the platform 130*a* to form a partially enclosed central aperture or recess 156*a* which is also configured and disposed to provide clearance for the ground contact 47*a* (or 47*b*) in FIG. 1 of the base 56 for various positions of the slider 110*a* as the slider advances towards and retracts from the ground contact 47*a* (or 47*b*). More particularly, the partially enclosed central aperture or recess 156*a* is defined by a front surface 154*a*' of the peripheral edge 154*a*.

The platform 130*a* has an upper surface 152*a* and a lower surface (not shown) that define a central inclined surface or ramp 158*a* that is also configured and disposed to divide the platform 130*a* into a first aperture portion 161*a* and a second aperture portion 162*a*, the first aperture portion 161*a* and the second aperture portion 162*a* each being adjacent to the central ramp 158*a* and on opposite sides thereof.

The first and second aperture portions 161*a* and 162*a* define first and second platform apertures 171*a* and 172*a* therein. The platform apertures 171*a* and 172*a* are each T-shaped apertures such that first and second apertures 171*a* and 172*a* include top aperture portions 171*a*' and 172*a*' and leg aperture portions 171*a*" and 172*a*", respectively, wherein the top aperture portions 171*a*' and 172*a*' are parallel to each other and parallel to the central ramp 158*a* that resides between the first and second aperture portions 161*a* and 162*a*. The first and second leg portions 171*a*" and 172*a*" are colinear and orthogonal to the direction of the central ramp 158*a*.

The platform apertures 171*a* and 172*a* being T-shaped and disposed as described allow for the insertion of therethrough of a set of blades of a plug that is designed for insertion into respective NEMA 5-15, NEMA 5-20, NEMA 6-15 or NEMA 6-20 receptacles, such as those described above with respect to and illustrated in FIGS. 1-9.

Additionally, the apertures 171*a* and 172*a* enable passage therethrough of a set of blades in a plug to enable the set of blades to establish contact with corresponding contacts in the tamper resistant receptacle, e.g., contacts 45*a* and 46*a* and contacts 45*b* and 46*b* in FIG. 1.

The central ramp 158*a* is inclined downwardly from a first end 158*a*' that is positioned above the upper surface 152*a* of the platform 130*a* to a second end 158*a*" that is positioned below the lower surface (not shown) of the platform 130*a*, the second end 158*a*" intersecting and bisecting the front surface 154*a*' of the peripheral edge 154*a* into two portions 1541*a*' and 1542*a*' on either side thereof.

Thus, a cavity 170*a* is defined by the platform 130*a*. Ramp 158*a* is defined within the cavity 170*a* with at least part of the base surface 158*a* including an angled surface.

That is, the platform 130*a* has an upper surface 152*a* that includes angled surface 158*a* at least partially defining cavity 170*a* in the upper surface 152*a* of platform 130*a*.

As seen in FIG. 1 and as described in more detail below, to allow sufficient travel of the slider 110*a* from a first position to a second position, the front surface portions 1541*a*' and 1542*a*'may have a height "H" that is greater than a thickness "t" of the peripheral edges 154*a* of the platform 130*a* at distal most positions with respect to the ramp 158*a*.

Platform 130*a* also includes first and second slider stop members 173*a* and 174*a* that are configured and disposed on, and project above, the upper surface 152*a*.

Returning to FIG. 14, the biasing member 150*a* (or 150*b*), illustrated in the exemplary form as a leaf spring, biases the slider 110*a* (or 110*b*) to a first position of the slider in which the slider blocks the set of T-shaped apertures 171*a* and 172*a* in the platform 130*a*.

Turning again to FIGS. 3-6, it can be seen that the slider 110*a* is in a first position blocking the platform apertures 171*a* and 172*a*. More particularly, in FIG. 3, the slider 110*a* is in a first position wherein the slider 110*a* extends across and beneath the set of apertures 241 and 242 formed in the cover 220 and also blocks the platform apertures 171*a* and 172*a*.

Similarly, in FIG. 4, the slider 110*a* is also in a first position wherein the slider 110*a* extends across and beneath the set of apertures 341 and 342 formed in the cover 320 and also blocks the platform apertures 171*a* and 172*a*.

In FIG. 5, the slider 110*a* is also in a first position wherein the slider 110*a* extends across and beneath the set of apertures 441 and 442 formed in the cover 420 and also blocks the platform apertures 171*a* and 172*a*.

Again, in FIG. 6, the slider 110*a* is in a first position wherein the slider 110*a* extends across and beneath the set of apertures 541 and 542 formed in the cover 520 and also blocks the platform apertures 171*a* and 172*a*.

Figure 15:
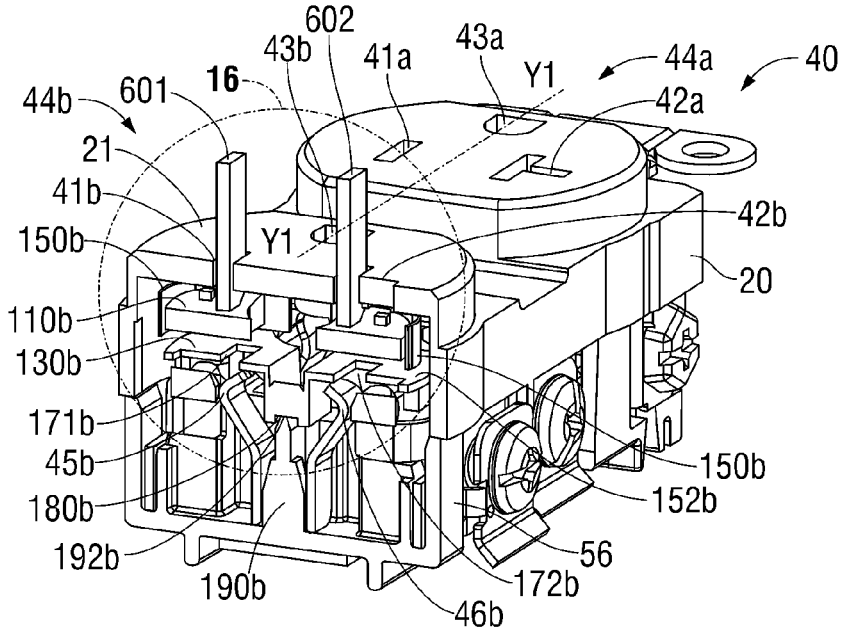
FIG. 15 is a perspective view of a NEMA 5-20 tamper-resistant duplex receptacle wherein a set of blades are in initial contact with the slider prior to the slider being urged from a first position to a second position according to one embodiment of the present disclosure.

Turning now to FIG. 15, a perspective view of a NEMA 5-20 tamper-resistant receptacle similar to the tamper-resistant NEMA 6-20 duplex receptacle 40 of FIGS. 1 and 2 there is illustrated a set of blades 601 and 602, representing proper insertion of a plug (not shown) into the receptacle 40. The set of blades 601 and 602 are being inserted simultaneously through the set of apertures 41*b* and 42*b*, respectively, formed in the cover 20 and are in initial contact with slider 110*b* (essentially identical to slider 110*a* described above) through apertures 41*b* and 42*b*, respectively, prior to the slider 110*b* being urged from the first position. As described above with respect to FIG. 2, those skilled in the art will recognize that the plug generally will also optionally include a ground or neutral prong (not shown) that enables the device (not shown) receiving electrical power from the receptacle 40 to be connected to ground. When the slider 110*b* is in the first position, the slider 110*b* blocks the set of apertures 41*b* and 42*b* formed in the cover 20 and also blocks the respective platform apertures 171*b* and 172*b* of platform 130*b* (essentially identical to platform 130*a* described above). (The elements of platform 130*b* are identical to the elements identified in FIG. 11 for platform 130*a* except that each element of platform 130*b* includes the suffix "b" instead of the suffix "a").

Figure 16:
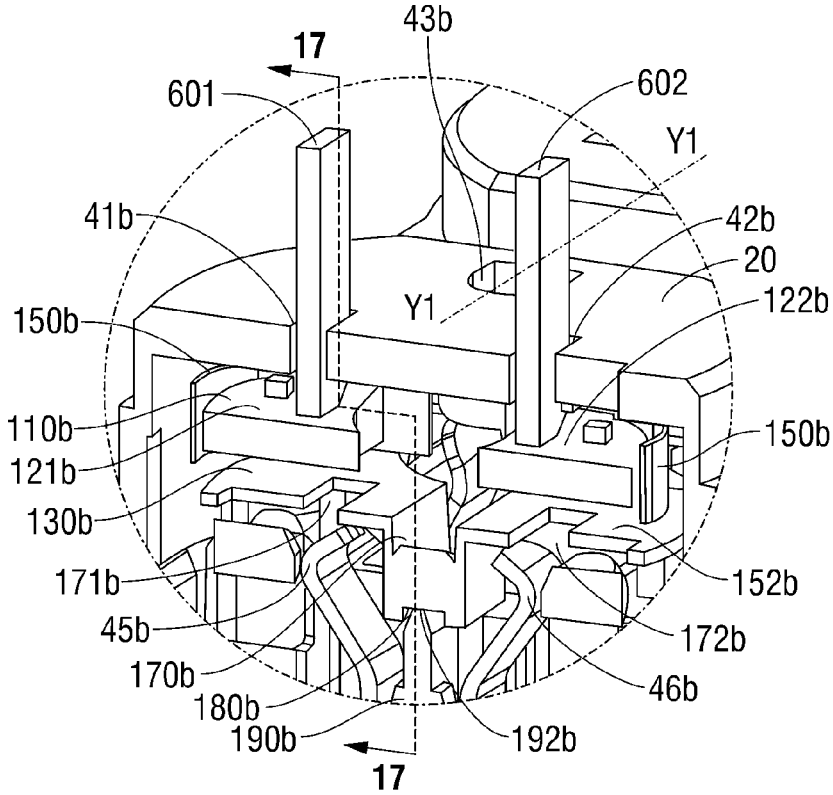
FIG. 16 is a detailed view of a portion of FIG. 15 illustrating the set of blades being in initial contact with the slider prior to the slider being urged from a first position to a second position according to one embodiment of the present disclosure.

As seen in FIGS. 15 and 16, platform 130*b* includes a channel 180*b* is formed in the lower surface thereof to enable the platform 130*b* to be stably supported by a platform support member 190*b* extending from a lower support wall 56' of base 56. The platform support member 190*b* projects from the lower support wall 56' to an upper end 192*b* that directly contacts the channel 180*b* formed in the lower surface (not shown) of the platform 130*b* to provide stable support for the platform 130*b*.

FIG. 16 is a detailed view of a portion of FIG. 15 illustrating the set of blades 601 and 602 being in initial contact with the slider 110*b* prior to the slider 110*b* being urged from the first position as described above with respect to FIG. 15. As best seen in FIG. 16, and as described with respect to FIG. 1, the base 56 includes a second set of contacts 48*b* that includes contacts 45*b* and 46*b*. As previously described, the platform 130*b* defines the apertures 171*b* and 172*b* therethrough to enable passage simultaneously of the set of blades 601 and 602 to establish contact with the corresponding contacts 45*b* and 46*b* and to define a second position of the slider and platform assembly 100*b* in which the slider 110*b* does not block the set of apertures 41*b* and 42*b* formed in the cover 20. The slider 110*b* is reciprocally disposed within cavity 170*b* of the platform 130*b*.

The first ground aperture 43*a* and the second ground aperture 43*b* may define an axis Y-Y therebetween.

Figure 17:
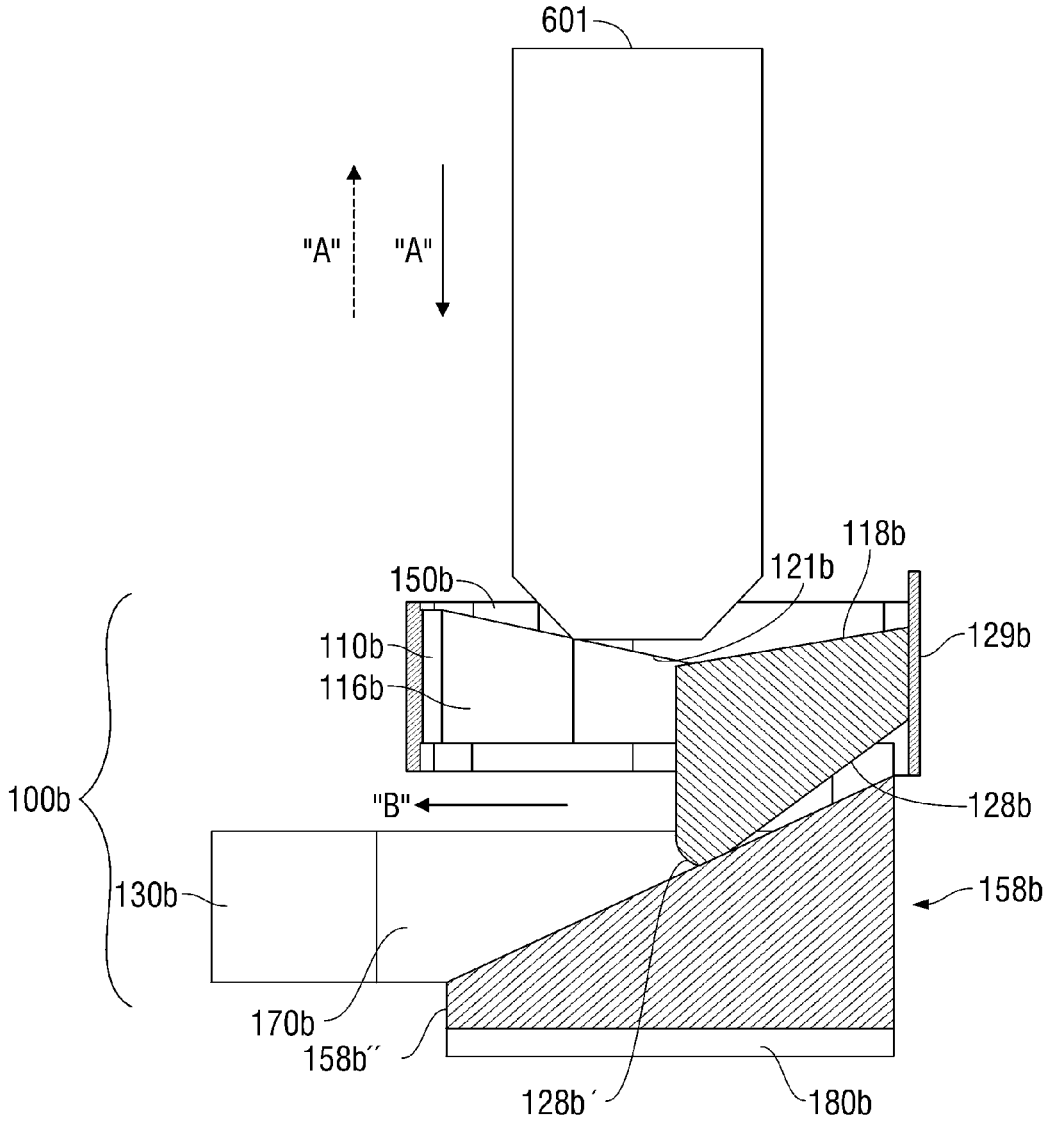
FIG. 17 is a side view of one blade of the set of blades of FIGS. 15 and 16 taken along section line 17-17 in FIG. 16 in contact with the slider on the slider and platform assembly.

FIG. 17 is a cross-sectional side view of one blade 601 of the set of blades of FIGS. 15 and 16 taken along section line 17-17 in FIG. 16 in contact with the slider 110*b* on the slider and platform assembly 100*b*.

In use, simultaneous insertion of the set of blades 601 and 602 through the set of apertures 41*b* and 42*b*, as shown in FIGS. 15 and 16, enables the set of blades 601 and 602 to establish contact with the corresponding contacts 45*b* and 46*b*.

In particular, the at least one angled surface of the slider, e.g., lower ramp 128*b* of slider 110*b*, cooperates with the angled surface 158*b* of the platform 130*b*. As seen in FIG. 17, when the set of blades 601 and 602 in a plug is inserted simultaneously in the direction of arrow "A" through the set of apertures 41*b* and 42*b*, respectively, formed in the cover 20, the blades 601 and 602 make contact with the at least one angled surface on the slider 110*b*, e.g. angled surfaces 121*b* and 122*b*, thereby urging at least another angled surface of the slider 110*b*, e.g., angled surface 128*b*, to contact the angled surface 158*b* of the platform 130*b* such that the slider 110*b* is urged from the first position to the second position in the direction of arrow "B". Thus, the one or more angled surfaces of the slider 110*b*, against which the set of blades 601 and 602 make contact, e.g., angled surfaces 121*b* and 122*b*, is oriented substantially perpendicular to an axis of insertion of the set of blades 601 and 601, wherein the axis of insertion of the set of blades 601 and 601 is substantially parallel to the arrow "A".

Thus, the slider 110*b* is movable between the first position in which the slider 110*b* blocks the set of apertures 41*b* and 42*b* formed in the cover 20 and the second position in which the slider 110*b* does not block the set of apertures 41*b* and 42*b* formed in the cover 20. The slider 110*b* is biased to the first position by biasing member 150*a*, which may include a leaf spring. As illustrated in FIGS. 5-9, the biasing member 150*a* is positioned around the peripheral edge 124*a* of the slider 110*a* that extends entirely around the slider 110*a*. The second position of slider 110*b* is illustrated in more detail in FIGS. 18-21 which follow.

Stated differently, in conjunction with FIGS. 11-13, the one or more angled surfaces 121*b* and 122*b* of the slider 110*b* define at least one surface that is simultaneously contacted by the set of blades 601 and 602. Ramp 158*b*, e.g., an angled surface, of the upper surface 152*b* of the platform 130*a* defines at least one camming surface engageable with the camming surface 128*b* of the slider 110*b*. Upon simultaneous contact of the one or more angled surfaces 121*b* and 122*b* of the slider 110*b*, by the set of blades 601 and 602 of a plug (not shown), through the set 44*b* of apertures 41*b* and 42*b* of the cover 20, in the direction indicated by arrow "A", the slider 110*b* is moved in a direction substantially parallel to the upper surface 152*b* of the platform 130*b* as indicated by the arrow "B", wherein the camming surfaces 128*b* and 158*b* inter-engage with one another and urge the slider from the first position to the second position.

As illustrated in FIG. 11, the biasing member 150*a* includes a support portion 151*a* and two movable arms 153*a* on opposite sides of the support portion 151*a*. Upon movement of the slider 110*a* in the second direction of arrow "B", the slider stop members 173*a* and 174*a* maintain the position of the support portion 151*a* of the biasing member 150*a* (or 150*b*) with respect to the platform 130*a* while the movable arms 153*a* of biasing member 150*a* swing outwardly away from the support portion 151*a*.

Figure 18:
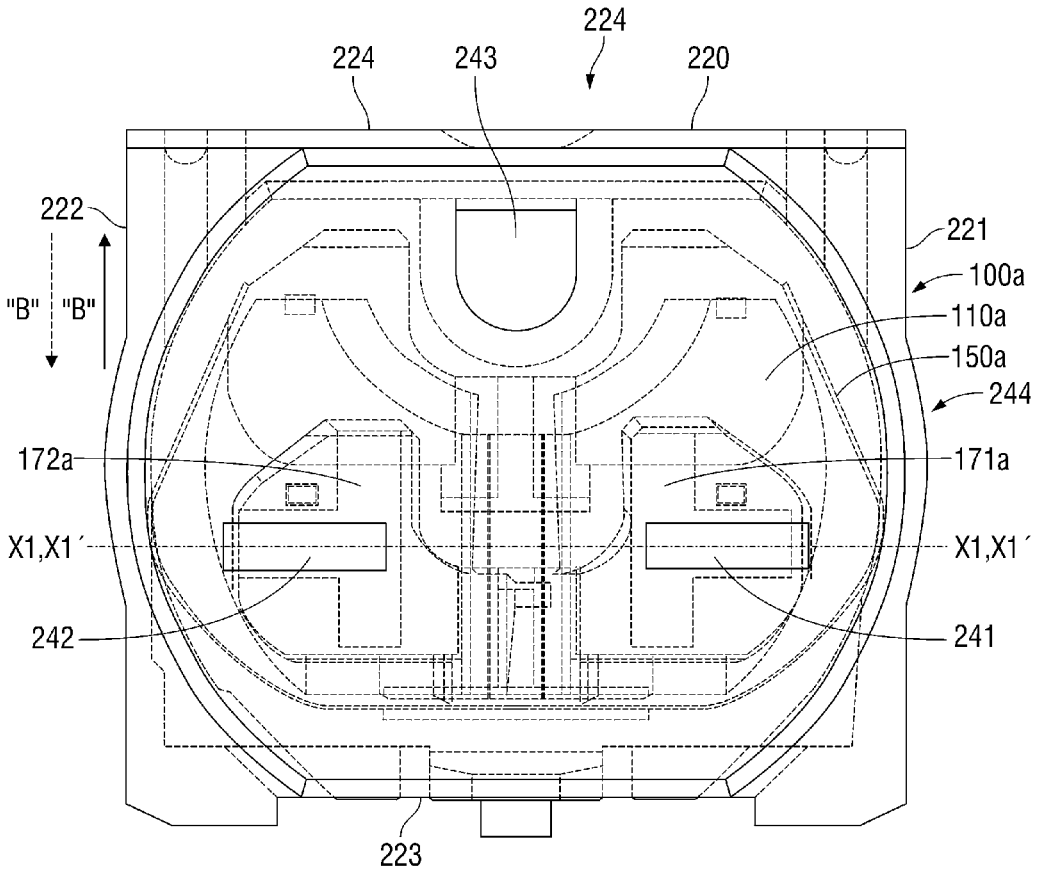
FIG. 18 is a front view of the NEMA 6-15 tamper-resistant single receptacle of FIG. 3 that includes the platform and slider assembly in which the slider has been urged to a second position according to one embodiment of the present disclosure.

FIG. 18 is a front view of the NEMA 6-15 tamper-resistant single receptacle 240 of FIG. 3 that includes the platform and slider assembly 100*a* in which the slider 110*a* has been urged to a second position in the direction of arrow "B" according to one embodiment of the present disclosure. As illustrated in both FIG. 3 and FIG. 18, cover 220 includes a first side 221 adjacent to first blade receiver aperture 241 and a second side 222 adjacent to second blade receiver aperture 242. Cover 220 also includes a first end 223 adjacent to both blade receiver apertures 241 and 242 and a second end 224 adjacent to ground aperture 243. An axis X1-X1 extends laterally between blade receiver apertures 241 and 242 from first side 221 to second side 222, such that the blade receiver apertures 241 and 242 define axis X1-X1 extending from one aperture 241 to the other aperture 242.

The slider 110*a* is disposed within the cavity 170*a* of the platform 130*a* wherein the slider 110*a* moves within the cavity 170*a* of the platform 130*a* in a direction orthogonal to the axis X1-X1, e.g., in the direction of arrow "B" towards second end 224 when the set of blades 601 and 602 are inserted simultaneously in the apertures 241 and 242 and in the direction of arrow "B'" towards first end 223 when the set of blades 601 and 602 are withdrawn simultaneously.

The motion of the slider 110*a* in the direction orthogonal to the axis X1-X1, in the direction of arrow "B", causes the slider 110*a* to move such that at least portions of the apertures 241 and 242 are simultaneously cleared from obstruction by the slider 110*a* to enable the set of blades 601 and 602 to move through the set of apertures 241 and 242 of the cover 220 and through the two or more apertures 171*a* and 172*a* defined in the platform 130*a*, to establish contact with the corresponding contacts, e.g., contacts 45*a* and 46*a* and contacts 45*b* and 46*b*, in FIGS. 1, 15 and 16 in the receptacle 240.

As can be appreciated from FIGS. 3 and 18, although the axis X1-X1 has been described as extending from one aperture 241 to the other aperture 242 of the cover 220, corresponding axis X1'-X1' may also be drawn laterally between first and second platform apertures 171*a* and 172*a* from first side 221 to second side 222 of the cover, such that the first and second platform apertures 171*a* and 172*a* define axis X1'-X1' extending from one aperture 171*a* to the other aperture 172*a*.

In a similar manner, the motion of the slider 110*a* in the direction orthogonal to the axis X1'-X1' in the direction of arrow "B" causes the slider 110*a* to move such that at least portions of the apertures 241 and 242 are simultaneously cleared from obstruction by the slider 110*a* to enable the set of blades 601 and 602 to move through the set of apertures 241 and 242 of the cover 220 and through the two or more apertures 171*a* and 172*a* defined in the platform 130*a* to establish contact with the corresponding contacts, e.g., contacts 45*a* and 46*a* and contacts 45*b* and 46*b*, in FIGS. 1, 15 and 16 in the receptacle 40.

It can be seen regardless of whether axis X1-X1 or axis X1'-X1' is chosen as the reference axis, the slider 110*a* moves to a second position such that at least portions of the apertures 241 and 242 are simultaneously cleared from obstruction by the slider 110*a* to enable the set of blades 601 and 602 to move through the set of apertures 241 and 242 of the cover 220 and through the two or more apertures 171*a* and 172*a* defined in the platform 130*a* to establish contact with the corresponding contacts, e.g., contacts 45*a* and 46*a* and contacts 45*b* and 46*b*, in FIGS. 1, 15 and 16 in the receptacle 40.

Thus, the slider 110*a* has moved to the second position that enables the set of blades 601 and 602 to move, past a side of slider 110*a*, through the set of apertures 241 and 242 of the cover 220 and through the two or more apertures 171*a* and 172*a* defined in the platform 130*a* to establish contact with the corresponding contacts, e.g., contacts 45*a* and 46*a* and contacts 45*b* and 46*b* in FIGS. 1, 15 and 16 in the receptacle 40.

Figure 19:
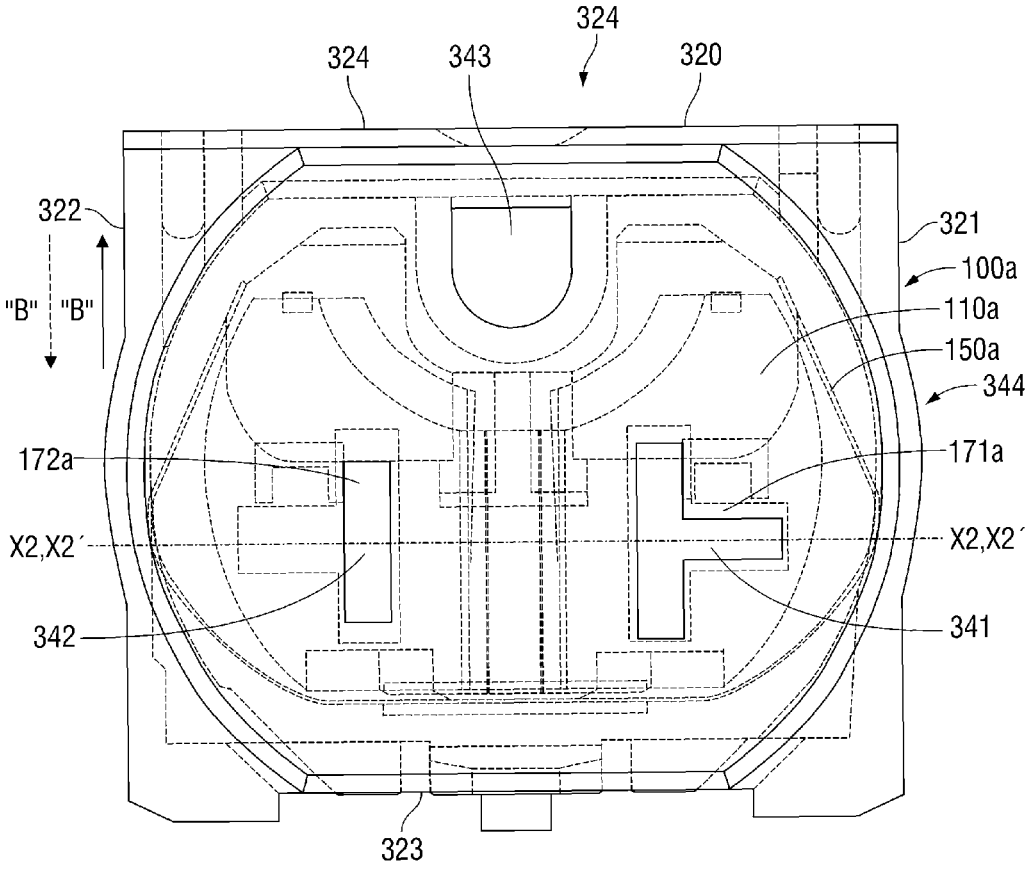
FIG. 19 is a front view of the NEMA 5-20 tamper-resistant single receptacle of FIG. 4 that includes the platform and slider assembly in which the slider has been urged to a second position according to one embodiment of the present disclosure.

In a similar manner, FIG. 19 is a front view of the NEMA 5-20 tamper-resistant single receptacle 340 of FIG. 4 that includes the platform and slider assembly 100*a* in which the slider 110*a* has been urged to a second position in the direction of arrow "B" according to one embodiment of the present disclosure. As illustrated in both FIG. 4 and FIG. 19, cover 320 includes a first side 321 adjacent to first blade receiver aperture 341 and a second side 322 adjacent to second blade receiver aperture 342. Cover 320 also includes a first end 323 adjacent to both blade receiver apertures 341 and 342 and a second end 324 adjacent to ground aperture 343. An axis X2-X2 extends laterally between blade receiver apertures 341 and 342 from first side 321 to second side 322, such that the blade receiver apertures 341 and 342 define axis X2-X2 extending from one aperture 341 to the other aperture 342.

Again, the slider 110*a* is disposed within the cavity 170*a* of the platform 130*a* wherein the slider 110*a* moves within the cavity 170*a* of the platform 130*a* in a direction orthogonal to the axis X2-X2, e.g., in the direction of arrow "B" towards second end 224 when the set of blades 601 and 602 are inserted simultaneously in the apertures 241 and 242 and in the direction of arrow "W" towards first end 223 when the set of blades 601 and 602 are withdrawn simultaneously.

The motion of the slider 110*a* in the direction orthogonal to the axis X2-X2, in the direction of arrow "B", again causes the slider 110*a* to move such that at least portions of the apertures 341 and 342 are simultaneously cleared from obstruction by the slider 110*a* to enable the set of blades 601 and 602 to move through the set of apertures 341 and 342 of the cover 320 and through the two or more apertures 171*a* and 172*a* defined in the platform 130*a*, to establish contact with the corresponding contacts, e.g., contacts 45*a* and 46*a* and contacts 45*b* and 46*b*, in FIGS. 1, 15 and 16 in the receptacle 40.

Similarly, as can be appreciated from FIGS. 4 and 19, although the axis X2-X2 has been described as extending from one aperture 341 to the other aperture 342 of the cover 320, corresponding axis X2'-X2' may also be drawn laterally between first and second platform apertures 171*a* and 172*a* from first side 321 to second side 322 of the cover, such that the first and second platform apertures 171*a* and 172*a* define axis X2'-X2' extending from one aperture 171*a* to the other aperture 172*a*.

In a similar manner, the motion of the slider 110*a* in the direction orthogonal to the axis X2'-X2' in the direction of arrow "B" causes the slider 110*a* to move such that at least portions of the apertures 341 and 342 are simultaneously cleared from obstruction by the slider 110*a* to enable the set of blades 601 and 602 to move through the set of apertures 341 and 342 of the cover 320 and through the two or more apertures 171*a* and 172*a* defined in the platform 130*a* to establish contact with the corresponding contacts, e.g., contacts 45*a* and 46*a* and contacts 45*b* and 46*b*, in FIGS. 1, 15 and 16 in the receptacle 40.

Again, it can be seen regardless of whether axis X2-X2 or axis X2'-X2' is chosen as the reference axis, the slider 110*a* moves to a second position such that at least portions of the apertures 341 and 342 are simultaneously cleared from obstruction by the slider 110*a* to enable a set of blades (not shown) configured to move through the set of apertures 341 and 342 of the cover 320 and through the two or more apertures 171*a* and 172*a* defined in the platform 130*a* to establish contact with the corresponding contacts, e.g., contacts 45*a* and 46*a* and contacts 45*b* and 46*b*, in FIGS. 1, 15 and 16 in the receptacle 40.

Again, the slider 110*a* has moved to the second position that enables the set of blades 601 and 602 to move, past a side of slider 110*a*, through the set of apertures 341 and 232 of the cover 320 and through the two or more apertures 171*a* and 172*a* defined in the platform 130*a* to establish contact with the corresponding contacts, e.g., contacts 45*a* and 46*a* and contacts 45*b* and 46*b* in FIGS. 1, 15 and 16 in the receptacle 40.

Figure 20:
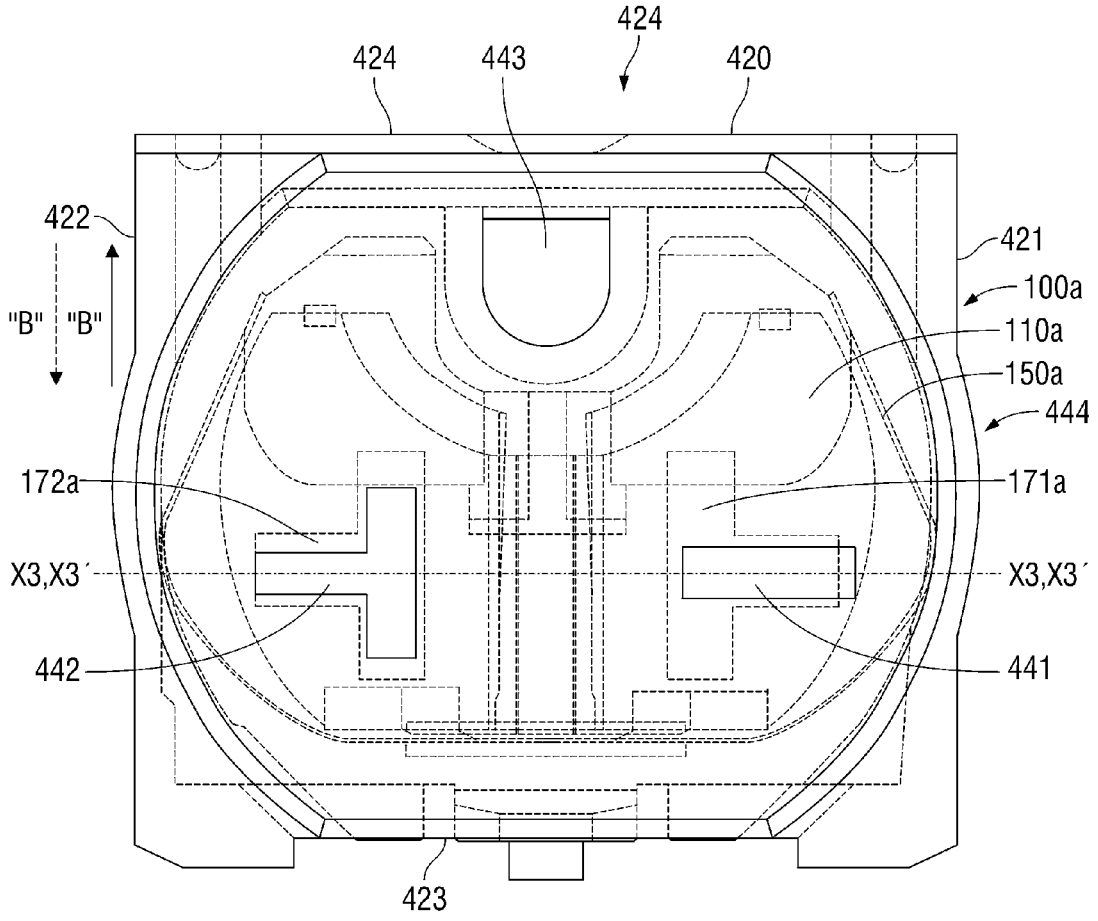
FIG. 20 is a front view of the NEMA 6-20 tamper-resistant single receptacle of FIG. 5 that includes the platform and slider assembly in which the slider has been urged to a second position according to one embodiment of the present disclosure.

In a similar manner, FIG. 20 is a front view of the NEMA 6-20 tamper-resistant single receptacle 440 of FIG. 5 that includes the platform and slider assembly 100*a* in which the slider 110*a* has been urged to a second position in the direction of arrow "B" according to one embodiment of the present disclosure. As illustrated in both FIG. 5 and FIG. 20, cover 420 includes a first side 421 adjacent to first blade receiver aperture 441 and a second side 422 adjacent to second blade receiver aperture 442. Cover 420 also includes a first end 423 adjacent to both blade receiver apertures 441 and 442 and a second end 424 adjacent to ground aperture 443. An axis X3-X3 extends laterally between blade receiver apertures 441 and 442 from first side 421 to second side 422, such that the blade receiver apertures 441 and 442 define axis X3-X3 extending from one aperture 441 to the other aperture 442.

Corresponding axis X3'-X3' may also be drawn laterally between first and second platform apertures 171*a* and 172*a* from first side 421 to second side 422 of the cover 420, such that the first and second platform apertures 171*a* and 172*a* define axis X3'-X3' extending from one aperture 171*a* to the other aperture 172*a*.

The movement of the slider and platform assembly 110*a* within the receptacle 440 is substantially identical to the movement of the slider and platform assembly 110*a* within the receptacles 40, 240 and 340, as described above with respect to FIGS. 1, 15, 16, 17, FIGS. 3 and 18, and FIGS. 4 and 19 and will not be described in detail. Those skilled in the art will recognize that, again, regardless of whether axis X3-X3 or axis X3'-X3' is chosen as the reference axis, the slider 110*a* moves to a second position such that at least portions of the apertures 441 and 442 are simultaneously cleared from obstruction by the slider 110*a* to enable a set of blades (not shown) configured to move through the set of apertures 441 and 442 of the cover 420 and through the two or more apertures 171*a* and 172*a* defined in the platform 130*a* to establish contact with the corresponding contacts, e.g., contacts 45*a* and 46*a* and contacts 45*b* and 46*b*, in FIGS. 1, 15 and 16 in the receptacle 40.

Figure 21:
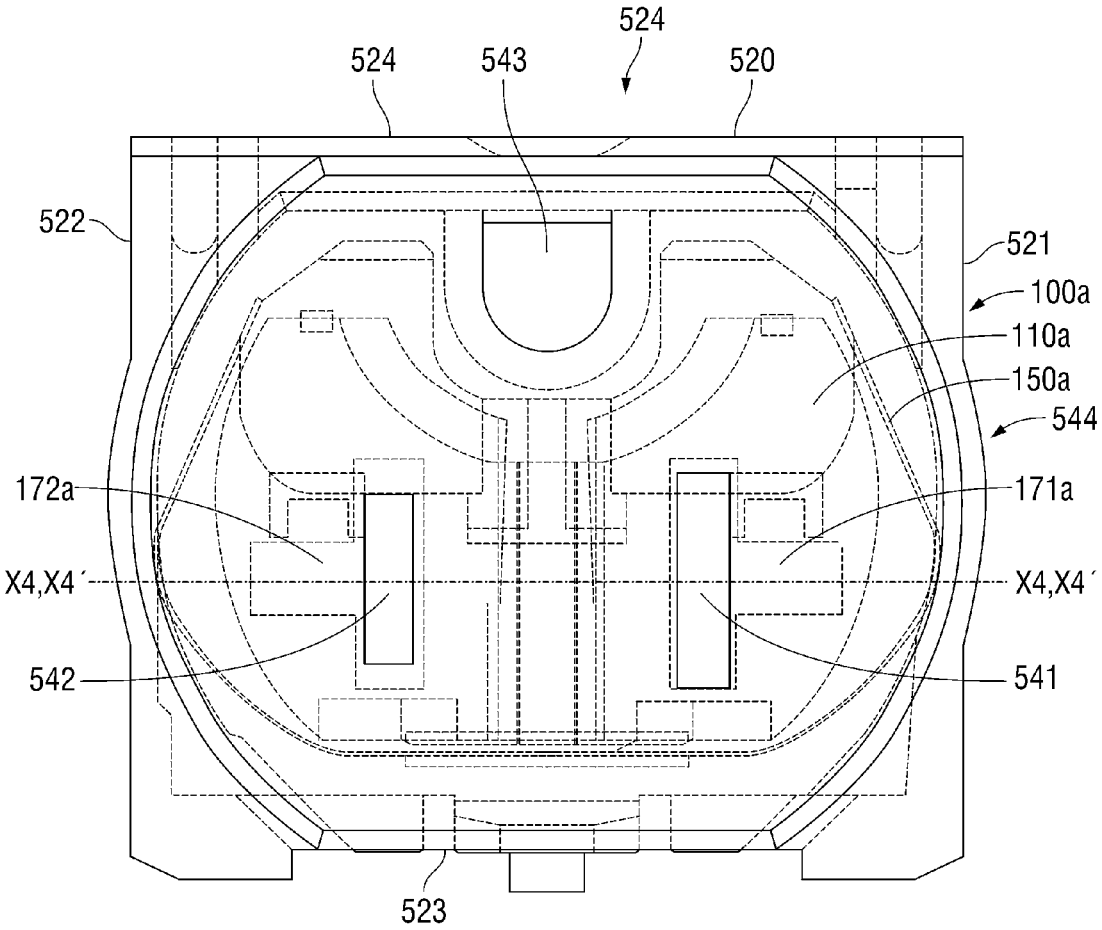
FIG. 21 is a front view of the NEMA 5-15 tamper-resistant single receptacle of FIG. 6 that includes the platform and slider assembly in which the slider has been urged to a second position according to one embodiment of the present disclosure.

Similarly, FIG. 21 is a front view of the NEMA 5-15 tamper-resistant single receptacle 540 of FIG. 6 that includes the platform and slider assembly 100*a* in which the slider 110*a* has been urged to a second position in the direction of arrow "B" according to one embodiment of the present disclosure. As illustrated in both FIG. 6 and FIG. 21, cover 520 includes a first side 521 adjacent to first blade receiver aperture 541 and a second side 522 adjacent to second blade receiver aperture 542. Cover 520 also includes a first end 523 adjacent to both blade receiver apertures 541 and 542 and a second end 524 adjacent to ground aperture 543. An axis X4-X4 extends laterally between blade receiver apertures 541 and 542 from first side 521 to second side 522, such that the blade receiver apertures 541 and 542 define axis X4-X4 extending from one aperture 541 to the other aperture 542.

Corresponding axis X4'-X4' may also be drawn laterally between first and second platform apertures 171*a* and 172*a* from first side 521 to second side 522 of the cover 520, such that the first and second platform apertures 171*a* and 172*a* define axis X4'-X4' extending from one aperture 171*a* to the other aperture 172*a*.

The movement of the slider and platform assembly 110*a* within the receptacle 540 is substantially identical to the movement of the slider and platform assembly 110*a* within the receptacles 40, 240, 340 and 440, as described above with respect to FIGS. 1, 15, 16, 17, FIGS. 3 and 18, FIGS. 4 and 19, and FIGS. 5 and 20 and will not be described in detail. Those skilled in the art will recognize that, again, regardless of whether axis X4-X4 or axis X4'-X4' is chosen as the reference axis, the slider 110*a* moves to a second position such that at least portions of the apertures 541 and 542 are simultaneously cleared from obstruction by the slider 110*a* to enable a set of blades (not shown) configured to move through the set of apertures 541 and 542 of the cover 520 and through the two or more apertures 171*a* and 172*a* defined in the platform 130*a* to establish contact with the corresponding contacts, e.g., contacts 45*a* and 46*a* and contacts 45*b* and 46*b*, in FIGS. 1, 15 and 16 in the receptacle 40.

As illustrated and described above with respect to FIGS. 15 and 16, the motion of the slider 110*a* in the direction of arrow "B" also coincides substantially with the direction of axis Y-Y defined between ground apertures 43*a* and 43*b*.

For each of the receptacles 240, 340, 440 and 540 described above with respect to FIGS. 18-21, respectively, upon simultaneous removal of the set of blades, e.g., blades 601 and 602, from the respective apertures, the biasing member 150*a* returns or retracts the slider 110*a* to the first position, such as by the coefficient of restitution of the spring force. Those skilled in the art will recognize that biasing members other than the leaf spring shown include coil springs or magnetic or electromagnetic components.

Figure 22:
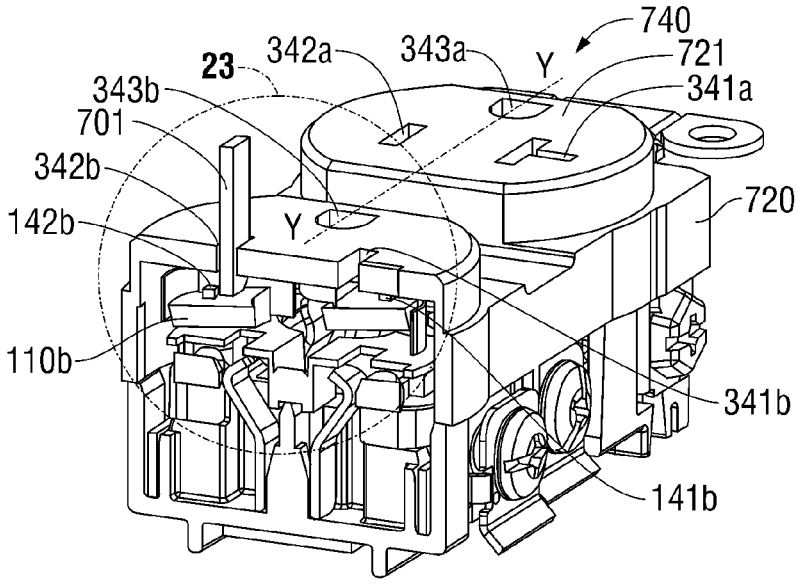
FIG. 22 is a perspective view of a NEMA 5-20 tamper-resistant duplex receptacle wherein a single object is used to probe apertures causing contact with the slider causing the slider to tilt around a longitudinal axis of the receptacle according to one embodiment of the present disclosure.

FIG. 22 is a perspective view of the NEMA 5-20 tamper-resistant duplex receptacle 720 of FIG. 9 having an exterior surface 721 wherein a single object 701 is used to probe a single aperture, e.g., blade aperture 342*b*, in the set of apertures 344*b* in the cover 720 and coming into contact with the slider 110*b* according to one embodiment of the present disclosure.

Figure 23:
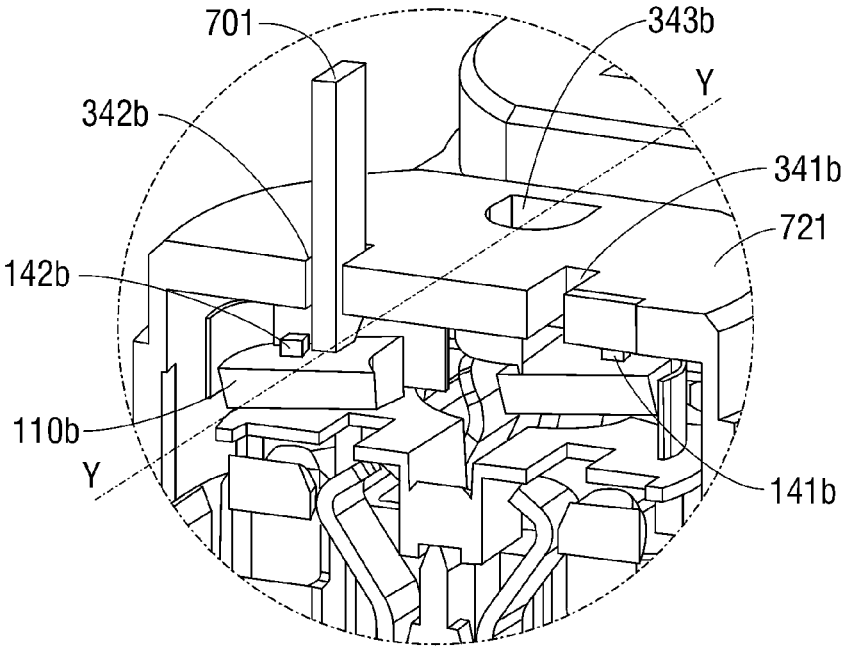
FIG. 23 is a detailed view of a portion of FIG. 22 illustrating the single object used to probe apertures causing contact with the slider causing the slider to tilt while preventing electrical contact with the single object according to one embodiment of the present disclosure.

FIG. 23 is a detailed view of a portion of FIG. 22 illustrating the single object 701 used to probe blade aperture 342*b* causing contact with the slider 110*b* according to one embodiment of the present disclosure.

Figure 24A:
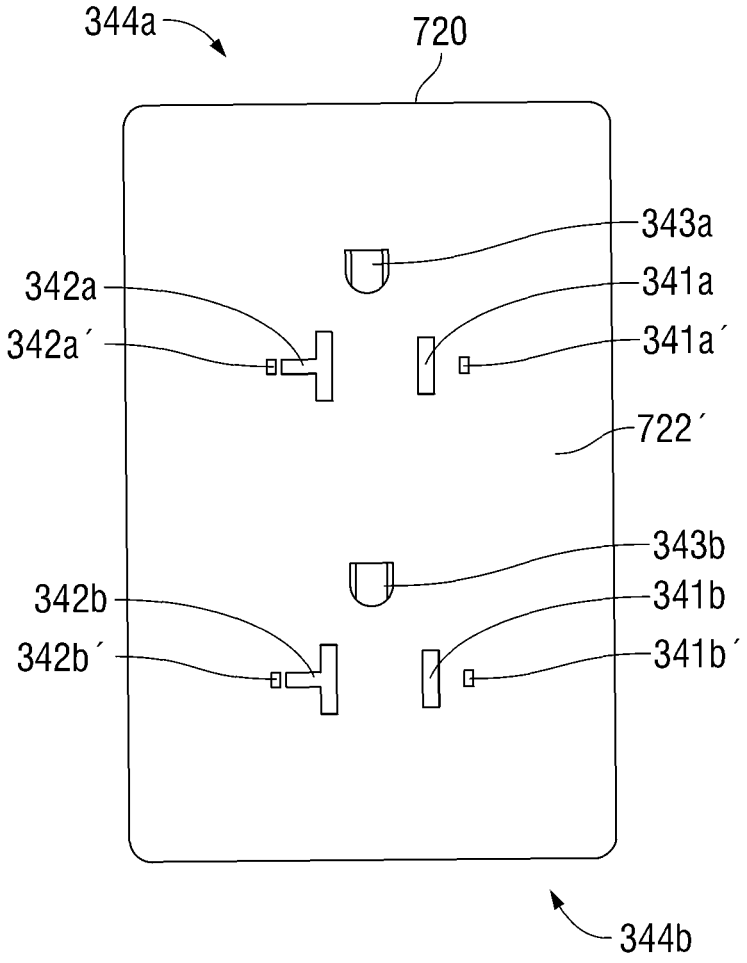
FIG. 24A is a view of the rear side of a cover of the NEMA 5-20 receptacle of FIGS. 22 and 23.

As described above with respect to FIG. 14A, in a similar manner, FIG. 24A illustrates a view of rear side 722 of the cover 720 of FIGS. 22 and 23 illustrating first single receptacle 344*a*. Receptacle 344*a* includes the first set of power apertures 341*a* and 342*a* and the ground aperture 343*a* and the second single receptacle 344*b* that includes the second set of power apertures 341*b* and 342*b* and the ground aperture 343*b*. The rear side 722 of the cover 720 includes first capture element engaging members 341*a*' and 341 b', e.g., in the form of recesses or the like, in proximity to and adjacent to first power apertures 341*a* and 341*b*, respectively. Additionally, the rear side 722 of the cover 720 also includes second capture element engaging members 342*a*' and 342*b*', e.g., in the form of recesses or the like, in proximity to and adjacent to second power apertures 342*a* and 342*b*, respectively.

Referring to both FIGS. 22 and 23, in conjunction with FIGS. 11-13 and FIG. 24A, the slider 110*b* includes first and second capture elements 141*b* and 142*b* and the cover 720 includes first and second capture element engaging members 341*a*', 341*b*' and 342*a*', 342*b*', respectively. When object 701 probes one of the apertures 341*a*, 342*a* and 341*b*, 342*b* of the cover 720, as shown in FIGS. 22 and 23, for example, when the object 701 probes aperture 342*b*, the slider 110*b* is canted with respect to the cover 720, e.g., the slider 110*b* tilts around the axis Y-Y that extends longitudinally between the ground apertures 343*a* and 343*b*, such that capture element 142*b* of the slider engages the capture element engaging member 342*b*' of the cover 720 thereby blocking movement of the slider 110*b* from the first position in which the slider 110*b* blocks the set of apertures 341*b* and 342*b* formed in the cover 720 to the second position in which the slider 110*b* does not block the set of apertures 341*a* and 342*b* formed in the cover 720. Thus, the pair of capture elements 141*b* and 142*b* the slider 110*b* block movement of the slider 110*b* from the first position to the second position when the probe or object 701 is inserted into just one aperture of the set of apertures of the cover, e.g., when the probe or object 701 is inserted into aperture 341*b* or 342*b*.

Those skilled in the art will recognize that, in a similar manner, the pair of capture elements 141*a* and 142*a* the slider 110*a* also block movement of the slider 110*a* from the first position to the second position when the probe or object 701 is inserted into one aperture of the set of apertures of the cover, e.g., when the probe or object 701 is inserted into aperture 341*a* or 342*a*.

Thus, either one of or both of the first and second capture elements 141*a*, 142*a* and 141*b*, 142*b* of the sliders 110*a* and 110*b*, respectively, are configured and disposed to block movement of the object 701 when the respective slider 110*a* or 110*b* is canted with respect to the cover 720, e.g., when the respective slider 110*a* or 110*b* tilts around the longitudinal axis Y-Y. The first capture element engaging members 341*a*' and 341*b*' are complementary to the respective first capture elements 141*a* and 141*b* while the second capture element engaging members 342*a*' and 342*b*' are complementary to the respective second capture elements 142*a* and 142*b*

Additionally, since the movable arms 153*a* or 153*b* of the respective biasing member 150*a* or 150*b* biases the respective slider 110*a* or 110*b* to the first position, upon withdrawal of the prove or object 701 from the receptacle in the direction of arrow "A", the movable arms 153*a* or 153*b* retract the respective slider 110*a* or 110*b* in the direction of arrow "B"' from the canted position to the uncanted or untilted position.

Referring again to FIGS. 3-6 and 15-21, it can also be appreciated that the respective cover 20, 220, 320, 420, 520 defines a reference plane that includes the respective axis X1-X1, X2-X2, X3-X3 and X4-X4. Referring to FIGS. 12 and 13, body portion 111*a* of the slider 110*a* defines at least first or upper surface 112*a* and second or lower surface 114*a*, opposite the first surface 112*a*. The lower surface 114*a* defines lower ramp 128*a* extending therefrom. Lower ramp 128*a* is configured to selectively engage a surface of the receptacle, e.g., the surface 158*b* of the platform 130*b* in receptacle 56 (see FIG. 17 and FIG. 1), when the slider 110*a* is moved in a direction orthogonal to the reference plane defined by the cover, e.g., in the direction of arrow "A" in FIG. 17 that is orthogonal to the reference plane defined by the respective cover 20, 220, 320, 420, 520. When lower ramp 128*a* engages surface 158*b*, the slider 110*a* is urged in a transverse direction relative to the cover, e.g., in the direction of arrow "B" in FIG. 17, from the first position in which the slider 110*a* blocks the set of apertures formed in the cover to a second position in which the slider does not block the set of apertures formed in the cover, as described above with respect to FIGS. 3-6 and FIGS. 18-21 for the respective covers 20, 220, 320, 420, 520.

It can also be appreciated that the body portion 111*a* of the slider 110*a* in FIGS. 12 and 13 defines an internal reference plane that is orthogonally oriented with respect to the axis of insertion of a plug, e.g., the axis defined in the direction of arrow "A" in FIG. 17.

Figure 25:
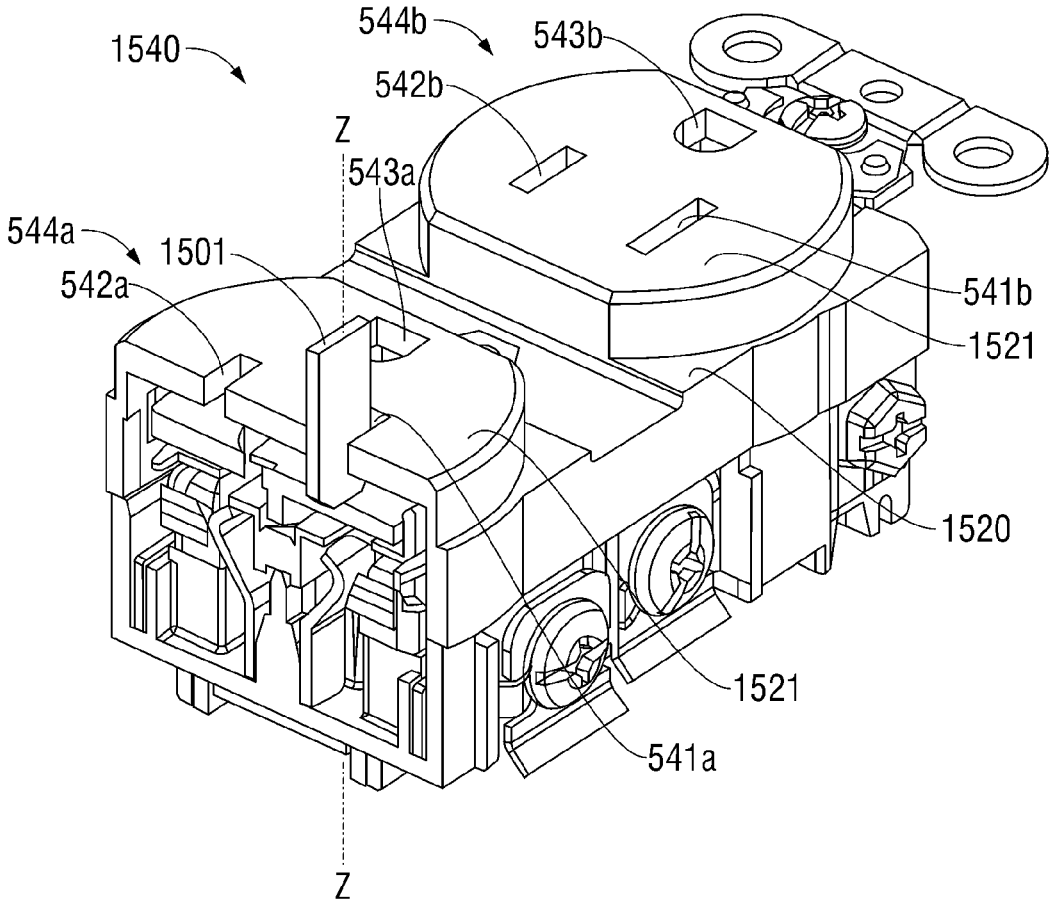
FIG. 25 is a perspective partial section view of a NEMA 5-15 tamper-resistant duplex receptacle wherein a single object is shown probing an aperture causing contact with the slider according to one embodiment of the present disclosure.

FIG. 25 illustrates a duplex version of the NEMA 5-15 tamper-resistant single receptacle described above with respect to FIGS. 6 and 21. For simplicity, similar numbering of components will be applied. More particularly, duplex tamper-resistant receptacle 1540 includes a cover 1520 having at least a set of apertures formed therein. More particularly, the cover 1520 includes a first set of power apertures 541*a* and 542*a* including a ground aperture 543*a* that form a first single receptacle 544*a* and a second set of power apertures 541*b* and 542*b* including a ground aperture 543*b* that form a second single receptacle 544*b*, the first and second receptacles 544*a* and 544*b*, respectively, forming the duplex receptacle 1540.

The receptacle 1540 includes a base or base assembly 1556 that is configured to receive the cover 1520. The base or base assembly 1556 includes a first set of contacts (not shown) that include contacts (not shown) that correspond to power apertures 541*a* and 542*a*, respectively, and contacts (not shown) that correspond to a ground aperture (not shown) in the cover 1520. The base 1556 also includes a second set of contacts (not shown) that include contacts (not shown) that correspond to apertures 541*b* and 542*b*, respectively, and contacts (not shown) that correspond to ground aperture 543*b* in the cover 1520.

A single object 1501 is used to probe a single aperture, e.g., power blade aperture 541*a*, in the set of apertures 544*a* in the cover 1520 and comes into contact with slider 110*a*.

An axis Z-Z is defined as being orthogonal to exterior surface 1521 formed on the cover 1520 of the receptacle 1540.

Figure 26:
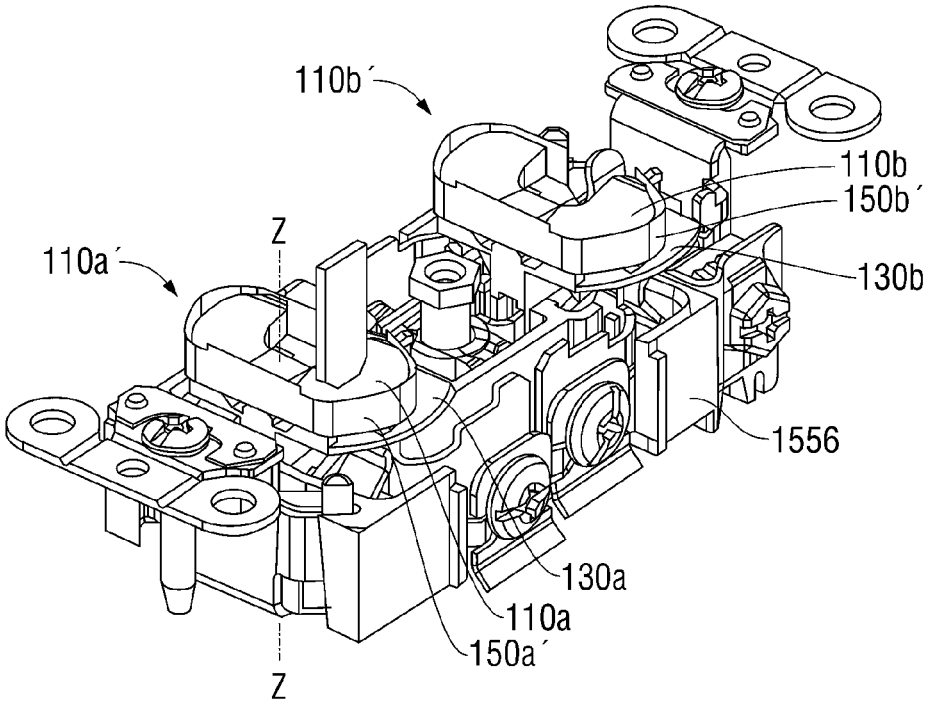
FIG. 26 is a full perspective view of the NEMA 5-15 tamper-resistant duplex receptacle of FIG. 25, without a cover, illustrating the single object probing an aperture causing contact with the slider.

FIG. 26 illustrates the NEMA 5-15 tamper-resistant duplex receptacle 1540 of FIG. 25, without the cover 1520, illustrating the single object 1501 probing an aperture 541*a* causing contact with the slider 110*a*.

In a similar manner as described above in FIG. 2 with respect to platform and slider assembly 100*a* and 100*b*, the receptacle 1540 includes first platform and slider assembly 100*a*' that includes the slider 110*a*, the corresponding platform 130*a* and a corresponding biasing member 150*a*' for biasing the slider 110*a* to transfer to an intermediate position blocking the platform apertures 171*a* and 172*a* in platform 130*a*, as described above with respect to FIG. 11 when the object 1501 is inserted into the blade aperture 541*a* of the cover 1520.

Similarly, second platform and slider assembly 100*b*' includes slider 110*b*, corresponding platform 130*b* and a corresponding biasing member 150*b*' for biasing the slider 110*b* to transfer to an intermediate position blocking the platform apertures 171*b* and 172*b* in platform 130*b* as analogously described above with respect to FIG. 11 when the object 1501 is inserted into the blade aperture 541*b* of the cover 1520.

Figure 27:
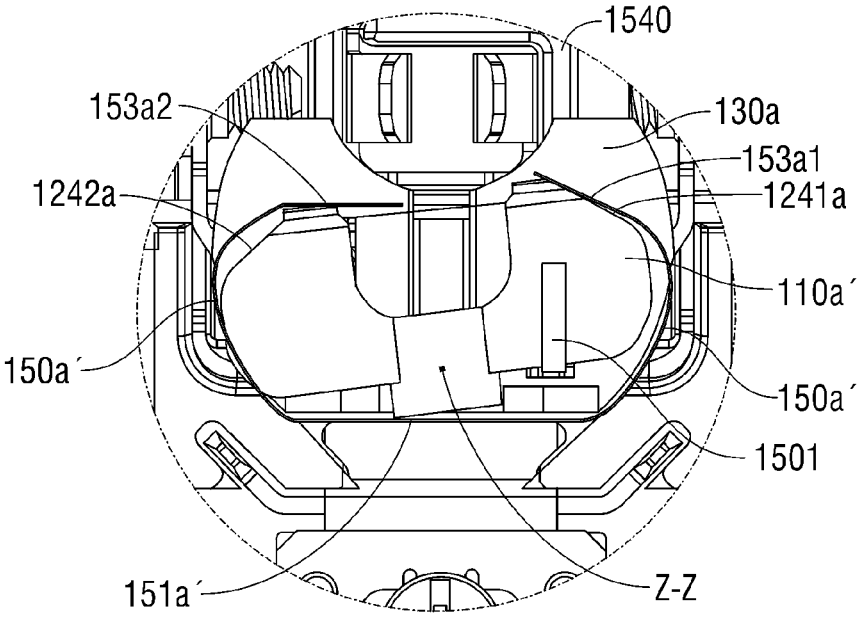
FIG. 27 is a detailed plan view of a portion of the NEMA 5-15 tamper-resistant duplex receptacle of FIGS. 25 and 26 illustrating the single object used to probe apertures causing contact with the slider causing the slider to rotate in a plane thereof while preventing electrical contact with the single object according to one embodiment of the present disclosure.

FIG. 27 is a detailed view of the NEMA 5-15 tamper-resistant duplex receptacle 1540 of FIGS. 25 and 26 illustrating the single object 1501 used to probe 541*a* causing contact with the slider 110*a*, which, in contrast to the tilting motion around axis Y-Y described above with respect to FIGS. 22 and 23, causes the slider to rotate around orthogonal axis Z-Z to thereby prevent electrical contact with the single object 1501.

In a similar manner as described above with respect to biasing member 150*a* illustrated in FIG. 11, the biasing member 150*a*' includes a support portion 151*a*' and two movable arms 153*a*1 and 153*a*2 on opposite sides of the support portion 151*a*'. The biasing member 150*a*' is disposed around the peripheral edges 124*a* of the slider 110*a* such that first movable arm 153*a*1 is in proximity to a first frontal edge portion 1241*a* of the peripheral edges 124*a* and second movable arm 153*a*2 is in proximity to a second frontal edge portion 1242*a* of the peripheral edges 124*a*. In one embodiment, the biasing member 150*a*' is a pre-loaded spring in which the second movable arm 153*a*2 provides a constraint to movement of the second frontal edge portion 1242*a* of the peripheral edge 124*a* of slider 110*a*.

Insertion of the single object 1501 into the aperture 541*a* causes an unsymmetrical load on the slider causing the slider to rotate or yaw around the axis Z-Z such that the slider 110*a* transfers to an intermediate position blocking the platform apertures 171*a* and 172*a* in platform 130*a* as described above with respect to FIG. 11

All the features disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention of the present disclosure is defined and limited only by the claims which follow.

What is claimed is:

1. A platform and slider assembly for use in a tamper resistant receptacle, the tamper resistant receptacle including a cover having first and second non-grounding apertures formed therein, the platform and slider assembly comprising:

a platform having a base surface, at least part of said base surface including an angled surface, the platform including first and second apertures adapted and configured for enabling passage of a set of blades in a plug to enable the set of blades to establish contact with corresponding contacts in the tamper resistant receptacle;

a slider reciprocally disposed adjacent the platform, the slider defining first and second angled surfaces, wherein the first angled surface of the slider cooperates with the angled surface of the platform, the slider being movable between a first position in which the slider blocks the first and second apertures formed in the cover and a second position in which the slider does not block the first and second apertures formed in the cover; and a biasing member operatively associated with the slider for biasing the slider to the first position, wherein when a set of blades of a plug is inserted along a first axis simultaneously through the first and second apertures formed in the cover, the blades make contact with the second angled surface on the slider urging the first angled surface of the slider to move with respect to the angled surface of the platform such that the slider is urged from the first position to the second position, wherein, during movement to the second position, the slider moves in a direction wherein at least portions of the first and second apertures formed in the platform are simultaneously cleared from obstruction by the slider to enable the set of blades to move through the first and second apertures formed in the cover and through the first and second apertures formed in the platform to establish contact with the corresponding contacts in the tamper resistant receptacle;

wherein the first and second apertures formed in the platform define a second axis extending from the first aperture to the second aperture; and wherein the slider moves relative to the platform in a direction orthogonal to the first axis and the second axis extending from the first aperture to the second aperture.

2. The platform and slider assembly according to claim 1, wherein when an object probes only one of the first and second apertures formed in the cover, the slider is constrained in the first position.

3. The platform and slider assembly according to claim 1, wherein when an object probes only one of the first and second apertures formed in the cover, the slider partially rotates about a center thereof such that a surface thereof contacts at least one of a surface of the platform and the biasing member to maintain the first and second apertures formed in the platform blocked.

4. The platform and slider assembly according to claim 1, wherein the slider includes a first nub and the cover includes a first recess, wherein when an object is inserted thru only one of the first and second apertures formed in the cover, the slider is canted with respect to the cover such that the first nub of the slider projects into the first recess of the cover thereby blocking movement of the slider from the first position to the second position.

5. The platform and slider assembly according to claim 4, wherein the slider includes a second nub and the cover includes a second recess, wherein when an object is inserted thru only one of the first and second apertures formed in the cover, the slider is canted with respect to the cover such that the second nub of the slider cooperates with the second recess of the cover to thereby block movement of the slider from the first position to the second position.

6. The platform and slider assembly according to claim 4, wherein the first nub of the slider is configured and disposed to block movement of the object when the slider is canted with respect to the cover.

7. The platform and slider assembly according to claim 5, wherein the second nub of the slider is configured and disposed to block movement of the object when the slider is canted with respect to the cover.

8. The platform and slider assembly according to claim 5, wherein both the first and second nubs of the slider are configured and disposed to block movement of the object when the slider is canted with respect to the cover.

9. The platform and slider assembly according to claim 1, wherein the biasing member is a spring.

10. The platform and slider assembly according to claim 1, wherein the slider and platform each include a complementary nub formed on or in a respective surface thereof for blocking movement of the slider from the first position to the second position when an object is inserted thru only one of the first and second apertures formed in the cover.

11. The platform and slider assembly according to claim 1, wherein the first angled surface of the slider defines at least one camming surface, and the angled surface of the platform defines at least one camming surface co-operable with the camming surface of the slider, wherein upon simultaneous contact of a surface of the slider by the set of blades of the plug through the first and second apertures formed in the cover and movement of the slider in the direction of the platform, the camming surfaces inter-engage with one another and urge the slider from the first position to the second position.

12. The platform and slider assembly according to claim 11, wherein the at least one camming surface of the slider terminates in a rounded end.

13. The platform and slider assembly according to claim 1, wherein the surface of the slider against which the set of blades make contact is oriented substantially perpendicular to an axis of insertion of the set of blades.

14. A platform and slider assembly for use in a tamper resistant receptacle, the tamper resistant receptacle including a cover having first and second apertures and a ground opening, the platform and slider assembly comprising:

a platform having a base surface, at least part of said base surface including an angled surface, the platform defining first and second apertures therein to enable passage therethrough of a set of blades in a plug to enable the set of blades to establish contact with corresponding contacts in the tamper resistant receptacle;

a slider reciprocally disposed adjacent the platform, the slider defining first and second angled surfaces, wherein the first angled surface of the slider cooperates with the angled surface of the platform, the slider being movable between a first position in which the slider blocks the first and second apertures formed in the cover and a second position in which the slider does not block the first and second apertures formed in the cover; and a biasing member operatively associated with the slider for biasing the slider to the first position, wherein when a set of blades in a plug is inserted along a first axis simultaneously through the first and second apertures formed in the cover, the blades make contact with the second angled surface on the slider urging the first angled surface of the slider to move with respect to the angled surface of the platform such that the slider is urged from the first position to the second position, wherein, in the second position, the slider has moved to a position enabling the set of blades to move directly through the first and second apertures of the cover directly through the first and second apertures formed in the platform to establish contact with the corresponding contacts in the tamper resistant receptacle, wherein the first and second apertures formed in the platform define a second axis extending from the first aperture to the second aperture, wherein the slider moves relative to the platform in a direction orthogonal to the first axis and the second axis extending from the first aperture to the second aperture, wherein motion of the slider in a direction orthogonal to the first and second axes causes the slider to move in a direction wherein at least portions of the first and second apertures formed in the platform are simultaneously cleared from obstruction by the slider to enable the set of blades to move through the first and second apertures formed in the cover and through the first and second apertures formed in the platform to establish contact with the corresponding contacts in the tamper resistant receptacle.

* * * * *